United States Patent [19]

Watanabe et al.

[11] Patent Number: 4,655,580

[45] Date of Patent: Apr. 7, 1987

[54] IMAGE FORMING APPARATUS WITH IMAGE FORMING AREA SELECTION

[75] Inventors: Junji Watanabe, Yokohama; Hideshi Oushiden, Kawasaki, both of Japan

[73] Assignee: Kabushiki Kaisha Toshiba, Kawasaki, Japan

[21] Appl. No.: 795,436

[22] Filed: Nov. 6, 1985

[30] Foreign Application Priority Data

| | | | |
|---|---|---|---|
| Nov. 6, 1984 | [JP] | Japan | 59-233557 |
| Nov. 19, 1984 | [JP] | Japan | 59-244115 |
| Mar. 26, 1985 | [JP] | Japan | 60-61478 |

[51] Int. Cl.[4] ..... G03G 15/00

[52] U.S. Cl. ..... 355/7; 355/14 R

[58] Field of Search ..... 355/7, 14 R, 3 R, 11

[56] References Cited

U.S. PATENT DOCUMENTS

| | | | |
|---|---|---|---|
| 4,046,471 | 9/1977 | Branham et al. | 355/3 R |
| 4,417,805 | 11/1983 | Kishi | 355/7 X |
| 4,582,417 | 4/1986 | Yagasaki et al. | 355/7 |

FOREIGN PATENT DOCUMENTS

| | | |
|---|---|---|
| A20098509 | 1/1984 | European Pat. Off. . |
| A1415062 | 12/1975 | United Kingdom . |
| A1487793 | 10/1977 | United Kingdom . |

*Primary Examiner*—R. L. Moses

*Attorney, Agent, or Firm*—Cushman, Darby & Cushman

[57] ABSTRACT

An image forming apparatus with an image forming area selection function has an original table on which a light-transmitting original is set such that an original image surface selectively faces upward or downward, a light-transparent section for emitting light transmitting through the original set such that the original image surface faces upward on the original table while the light is shifted with respect to the original, an erasure area specifying section for specifying an unnecessary portion of the original image surface to specify an erasure area while the light from the light-transmitting section is being shifted, an erasure area storage section for storing position data of the erasure area specified by the erasure area specifying section, an original scanning section, having an optical system moved along the original table, for scanning the original placed such that the original image surface faces downward, an image forming section for focusing light emitted from the original scanning section and reflected by the original and for developing an image on an image forming medium to form an image, an image erasing section for selectively erasing an image to be formed by the image forming section, and a control section for reading out the position data corresponding to the erasure area from the erasure area storage section at any time during the operation of the image forming section.

20 Claims, 56 Drawing Figures

FIG. 11
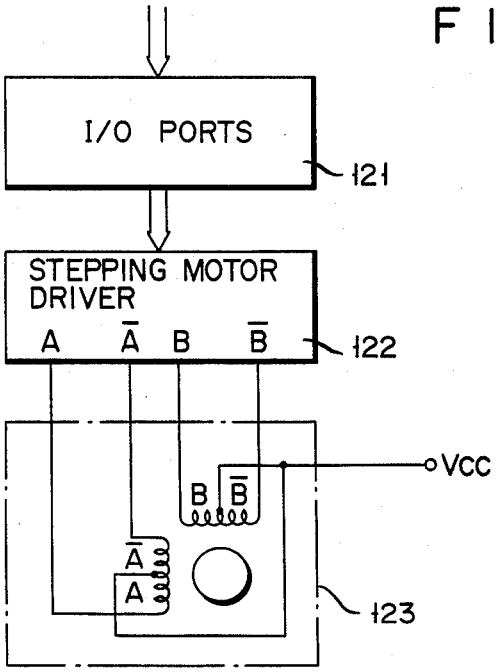
FIG. 12A
FIG. 12B
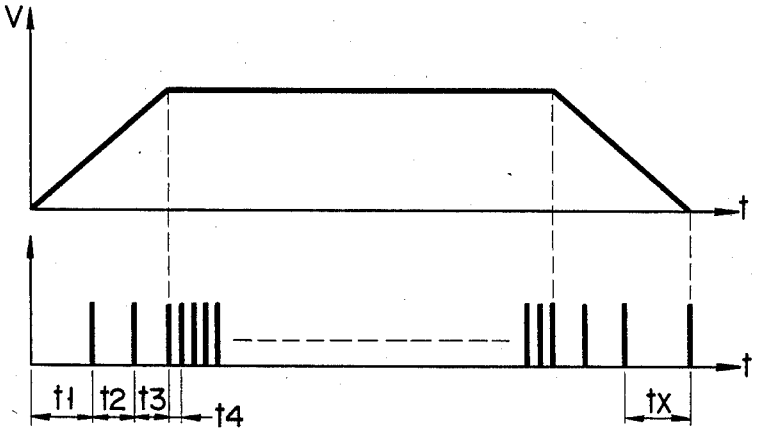

FIG. 34

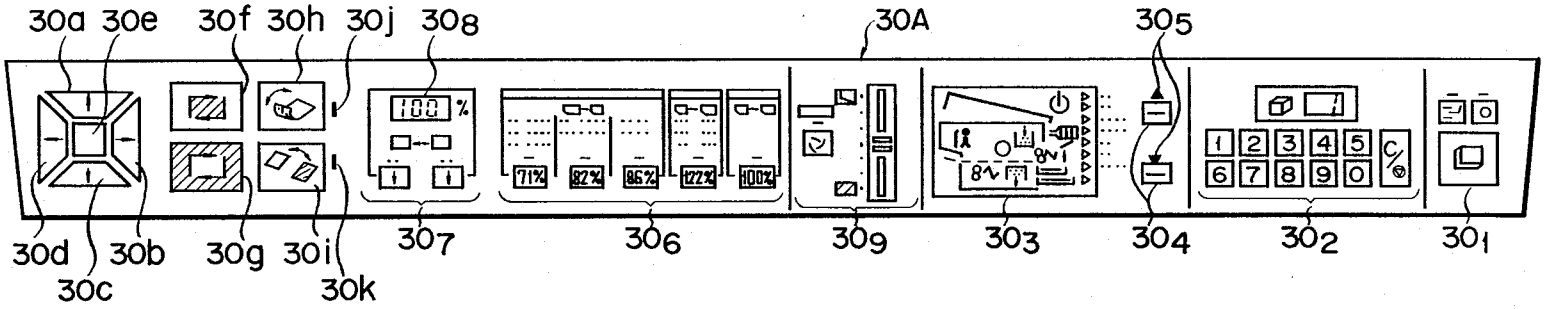
30a
30e
30f
30h
30j
30k
30i
30g
30b
30c
30d
30A
30l
30m
30n
30o
30p
30q
30r
30s
30t
30u
30v
30w
30x
30y
30z
30aa
30ab
30ac
30ad
30ae
30af
30ag
30ah
30ai
30aj
30ak
30al
30am
30an
30ao
30ap
30aq
30ar
30as
30at
30au
30av
30aw
30ax
30ay
30az
30ba
30bb
30bc
30bd
30be
30bf
30bg
30bh
30bi
30bj
30bk
30bl
30bm
30bn
30bo
30bp
30bq
30br
30bs
30bt
30bu
30bv
30bw
30bx
30by
30bz
30ca
30cb
30cc
30cd
30ce
30cf
30cg
30ch
30ci
30cj
30ck
30cl
30cm
30cn
30co
30cp
30cq
30cr
30cs
30ct
30cu
30cv
30cw
30cx
30cy
30cz
30da
30db
30dc
30dd
30de
30df
30dg
30dh
30di
30dj
30dk
30dl
30dm
30dn
30do
30dp
30dq
30dr
30ds
30dt
30du
30dv
30dw
30dx
30dy
30dz
30ea
30eb
30ec
30ed
30ee
30ef
30eg
30eh
30ei
30ej
30ek
30el
30em
30en
30eo
30ep
30eq
30er
30es
30et
30eu
30ev
30ew
30ex
30ey
30ez
30fa
30fb
30fc
30fd
30fe
30ff
30fg
30fh
30fi
30fj
30fk
30fl
30fm
30fn
30fo
30fp
30fq
30fr
30fs
30ft
30fu
30fv
30fw
30fx
30fy
30fz
30ga
30gb
30gc
30gd
30ge
30gf
30gg
30gh
30gi
30gj
30gk
30gl
30gm
30gn
30go
30gp
30gq
30gr
30gs
30gt
30gu
30gv
30gw
30gx
30gy
30gz
30ha
30hb
30hc
30hd
30he
30hf
30hg
30hh
30hi
30hj
30hk
30hl
30hm
30hn
30ho
30hp
30hq
30hr
30hs
30ht
30hu
30hv
30hw
30hx
30hy
30hz
30ia
30ib
30ic
30id
30ie
30if
30ig
30ih
30ii
30ij
30ik
30il
30im
30in
30io
30ip
30iq
30ir
30is
30it
30iu
30iv
30iw
30ix
30iy
30iz
30ja
30jb
30jc
30jd
30je
30jf
30jg
30jh
30ji
30jj
30jk
30jl
30jm
30jn
30jo
30jp
30jq
30jr
30js
30jt
30ju
30jv
30jw
30jx
30jy
30jz
30ka
30kb
30kc
30kd
30ke
30kf
30kg
30kh
30ki
30kj
30kk
30kl
30km
30kn
30ko
30kp
30kq
30kr
30ks
30kt
30ku
30kv
30kw
30kx
30ky
30kz
30la
30lb
30lc
30ld
30le
30lf
30lg
30lh
30li
30lj
30lk
30ll
30lm
30ln
30lo
30lp
30lq
30lr
30ls
30lt
30lu
30lv
30lw
30lx
30ly
30lz
30ma
30mb
30mc
30md
30me
30mf
30mg
30mh
30mi
30mj
30mk
30ml
30mm
30mn
30mo
30mp
30mq
30mr
30ms
30mt
30mu
30mv
30mw
30mx
30my
30mz
30na
30nb
30nc
30nd
30ne
30nf
30ng
30nh
30ni
30nj
30nk
30nl
30nm
30nn
30no
30np
30nq
30nr
30ns
30nt
30nu
30nv
30nw
30nx
30ny
30nz
30oa
30ob
30oc
30od
30oe
30of
30og
30oh
30oi
30oj
30ok
30ol
30om
30on
30oo
30op
30oq
30or
30os
30ot
30ou
30ov
30ow
30ox
30oy
30oz
30pa
30pb
30pc
30pd
30pe
30pf
30pg
30ph
30pi
30pj
30pk
30pl
30pm
30pn
30po
30pp
30pq
30pr
30ps
30pt
30pu
30pv
30pw
30px
30py
30pz
30qa
30qb
30qc
30qd
30qe
30qf
30qg
30qh
30qi
30qj
30qk
30ql
30qm
30qn
30qo
30qp
30qq
30qr
30qs
30qt
30qu
30qv
30qw
30qx
30qy
30qz
30ra
30rb
30rc
30rd
30re
30rf
30rg
30rh
30ri
30rj
30rk
30rl
30rm
30rn
30ro
30rp
30rq
30rr
30rs
30rt
30ru
30rv
30rw
30rx
30ry
30rz
30sa
30sb
30sc
30sd
30se
30sf
30sg
30sh
30si
30sj
30sk
30sl
30sm
30sn
30so
30sp
30sq
30sr
30ss
30st
30su
30sv
30sw
30sx
30sy
30sz
30ta
30tb
30tc
30td
30te
30tf
30tg
30th
30ti
30tj
30tk
30tl
30tm
30tn
30to
30tp
30tq
30tr
30ts
30tt
30tu
30tv
30tw
30tx
30ty
30tz
30ua
30ub
30uc
30ud
30ue
30uf
30ug
30uh
30ui
30uj
30uk
30ul
30um
30un
30uo
30up
30uq
30ur
30us
30ut
30uu
30uv
30uw
30ux
30uy
30uz
30va
30vb
30vc
30vd
30ve
30vf
30vg
30vh
30vi
30vj
30vk
30vl
30vm
30vn
30vo
30vp
30vq
30vr
30vs
30vt
30vu
30vv
30vw
30vx
30vy
30vz
30wa
30wb
30wc
30wd
30we
30wf
30wg
30wh
30wi
30wj
30wk
30wl
30wm
30wn
30wo
30wp
30wq
30wr
30ws
30wt
30wu
30wv
30ww
30wx
30wy
30wz
30xa
30xb
30xc
30xd
30xe
30xf
30xg
30xh
30xi
30xj
30xk
30xl
30xm
30xn
30xo
30xp
30xq
30xr
30xs
30xt
30xu
30xv
30xw
30xx
30xy
30xz
30ya
30yb
30yc
30yd
30ye
30yf
30yg
30yh
30yi
30yj
30yk
30yl
30ym
30yn
30yo
30yp
30yq
30yr
30ys
30yt
30yu
30yv
30yw
30yx
30yy
30yz
30za
30zb
30zc
30zd
30ze
30zf
30zg
30zh
30zi
30zj
30zk
30zl
30zm
30zn
30zo
30zp
30zq
30zr
30zs
30zt
30zu
30zv
30zw
30zx
30zy
30zz

IMAGE FORMING APPARATUS WITH IMAGE FORMING AREA SELECTION

BACKGROUND OF THE INVENTION

This invention relates to an image forming apparatus which can form a selected portion of an image and, more particularly, to an apparatus suitable for an electronic copying machine or the like for forming a desired portion of an original image.

A conventional electronic copying machine can provide a copy of an original iamge, with an equal, enlarged or reduced size.

Original images often includes portions which need not be copied. No conventional copying machines can copy the original image, except for an unnecessary portion.

SUMMARY OF THE INVENTION

The object of the present invention is to provide an image forming apparatus which can form only a selected portion of an original image, not forming an unnecessary portion thereof.

When the invention is applied to, for example, a copying machine, a spot light is applied on an original placed on an original table with its copying surface turned downward. The spot light is moved on the image, thus specifying an erasure area. Then, the original is turned over, having its copying surface turned upward. Light is applied on the origianl, and passes through it, thus illuminating that surface portion of a photosensitive drum which corresponds to the erasure area, thus erasing a portion of an electrostatic latent image from the surface portion of the drum.

According to this invention, there is provided an image forming apparatus which can form a selected portion of an image, the apparatus comprising: an original table on which a light-transparent original is placed with an original image surface turned upward or downward; light-transmitting means for emitting light through the original placed on the original table, with the original image surface turned upward, while the light is moved relative to the original; erasure area specifying means for specifying an unnecessary portion of the original image, while the light is being moved; erasure area storage means for storing the data representing the position of the erasure area specified by the erasure area specifying means; original scanning means having an optical system movable along the original table, and adapted to scan the original placed on the original table, with the original image surface turned downward; image forming means for focusing the light emitted from the original scanning means and then reflected by the original for developing an image on an image forming medium; image erasing means for causing the image forming means to form the image, except for a selected portion thereof; and control means for reading the data representing the position of the erasure area from the erasure area storage means at any time during the operation of the image forming means, and for supplying this data to the image erasing means.

BRIEF DESCRIPTION OF THE DRAWINGS

FIG. 1 to FIGS. 24A to 24I show an embodiment of an image forming apparatus according to the present invention, in which:

FIGS. 1 and 2 are a schematic perspective view and a side sectional view, respectively, showing the construction of the image forming apparatus;

FIG. 3 is a plan view of a control panel;

FIG. 4 is a perspective view showing an arrangement of drive sections;

FIG. 5 is a perspective view schematically showing a drive mechanism for an optical system;

FIG. 6 is a perspective view schematically showing a drive mechanism for indexes;

FIG. 7 is a block diagram a general control circuit;

FIG. 8 is a functional block diagram of a main processor group;

FIG. 9 is a functional block diagram of a first sub-processor group;

FIG. 10 is a functional block diagram of a second sub-processor group;

FIG. 11 is a block diagram showing a pulse motor control circuit;

FIGS. 12A and 12B are respectively charts for explaining a method of controlling a speed of a stepping motor;

FIG. 13 is a perspective view of the principal part including a spot light source;

FIG. 14 is a side sectional view of the principal part including the spot light source;

FIGS. 15, 16 and 17 are plan views illustrating an operation for specifying the erasure range of the original using the spot light source;

FIG. 18 is a perspective view showing the principal part to explain an original turnover direction;

FIGS. 20 and 21 are a perspective view and a front view, respectively, of only the principal part of the erasure array, showing the relationship between the erasure array and a photosensitive drum;

FIG. 23 is a circuit diagram illustrating the configuration of an array drive section; and FIGS. 24A to 24I are respectively flow charts for explaining the erasure operation of the original;

FIGS. 25 to 33 show a second embodiment of an image forming apparatus according to the present invention, in which:

FIGS. 25 and 26 are a schematic perspective view and a side sectional view, respectively, showing the construction of the image forming apparatus;

FIGS. 27, 28 and 29 are plan views illustrating an operation for specifying the erasure range of the original using the spot light source;

FIG. 30 is a perspective view showing the principal part for explaining the original turnover direction;

FIG. 32. is a circuit diagram illustrating the configuration of an array drive section; and FIG. 33 is a plan view for explaining the operation of a first carriage $41_1$; and FIGS. 34 to 43 show a third embodiment of an image forming apparatus according to the present invention, in which:

FIG. 34 is a plan view showing the configuration of a control panel;

FIGS. 35 to 37 are respectively plan views for explaining the operation for specifying an erasure range of the original;

FIG. 38 is a perspective view for explaining the original turnover direction;

FIGS. 40 to 42 are plan views for explaining operations for specifying erasure ranges by using spot light sources, respectively; and FIG. 43 is a perspective view showing the principal portion for explaining the original turnover direction.

DETAILED DESCRIPTION OF THE PREFERRED EMBODIMENTS

Preferred Embodiments of the present invention will be described with reference to the accompanying drawings.

Figure 1:
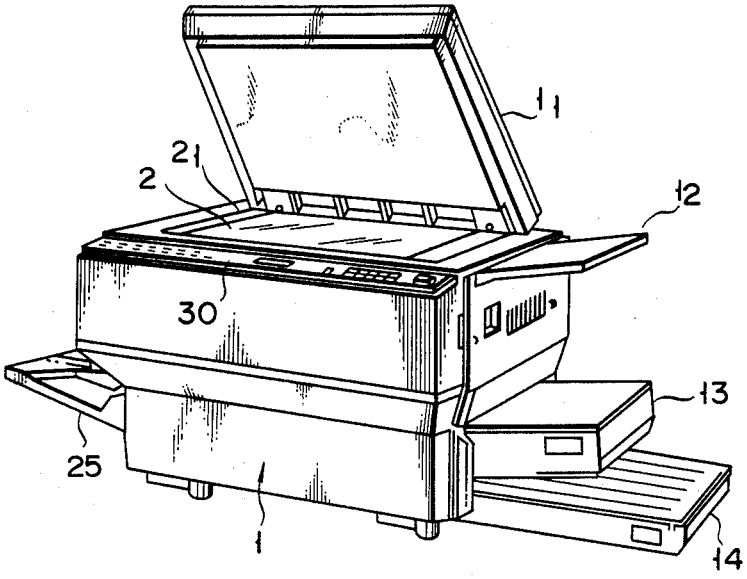
Figure 2:
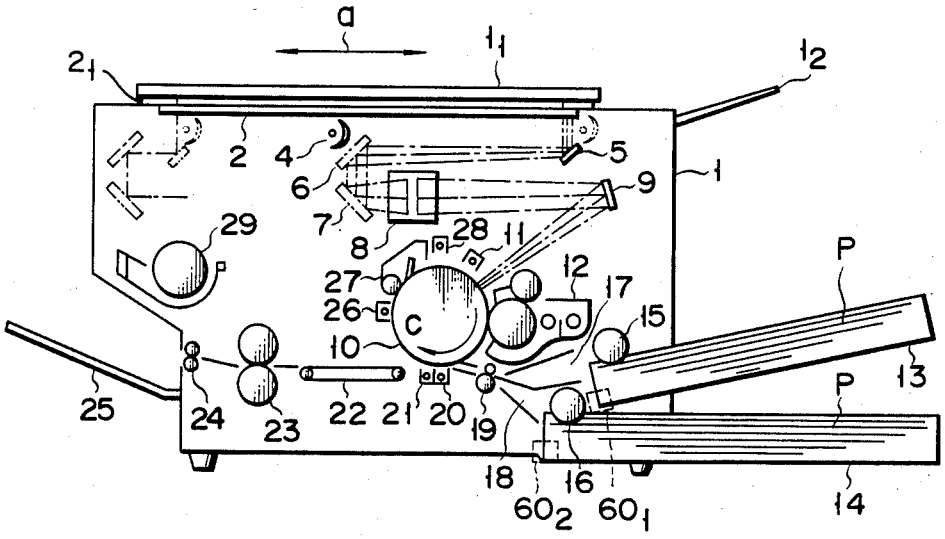

FIGS. 1 and 2 schematically show a copying machine as an image forming apparatus according to a first embodiment of the present invention. Reference numeral 1 denotes a copying machine housing. An original table (i.e., a transparent glass) 2 is fixed on the upper surface of the housing 1. An openable original cover $1_1$ and a work table $1_2$ are arranged near the table 2. A fixed scale $2_1$ as a reference for setting an original is arranged at one end of the table 2 along the longitudinal direction thereof.

The original set on the original table 2 is scanned for image exposure as an optical system 3 including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror 9 to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11. The image of the original is projected on the charged surface of the photosensitive drum 10 by slit exposure, forming an electrostatic latent image on the surface. The electrostatic latent image is developed into a visible image (toner image) by a developing unit 12 using toner. Paper sheets (image record media) P are delivered one by one from an upper paper cassette 13 or a lower paper cassette 14 by a paper-supply roller 15 or 16, and guided along a paper guide path 17 or 18 to an aligning roller pair 19. Then, each paper sheet P is delivered to a transfer region by the aligning roller pair 19, timed to the formation of the visible image.

The two paper cassettes 13 and 14 are removably attached to the lower right end portion of the housing 1, and can be alternatively selected by operation on a control panel which will be described in detail later. The paper cassettes 13 and 14 are provided respectively with cassette size detecting switches 601 and 602 which detect the selected cassette size. The detecting switches 601 and 602 are each formed of a plurality of microswitches which are turned on or off in response to insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image is fixed on the sheet P. After the fixation, the paper sheet P is discharged into a tray 25 outside the housing 1 by an exit roller pair 24.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 28 to restore the initial state. In FIG. 2, numeral 29 designates a cooling fan for preventing the temperature inside the housing 1 from rising.

Figure 3:
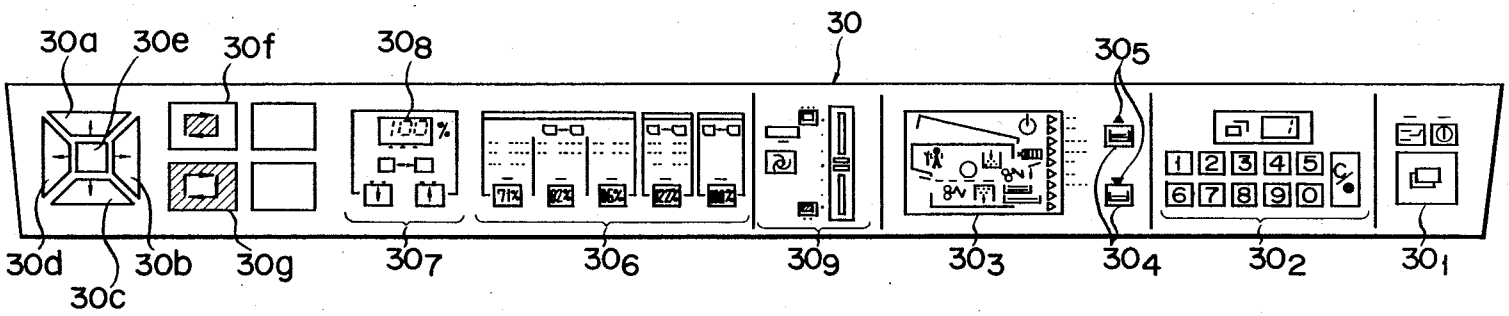

FIG. 3 shows a control panel 30 mounted on the housing 1. The control panel 30 carries thereon a copy key $30_1$ for starting the copying operation, ten-keys $30_2$ for setting the number of copies to be made and the like, a display section $30_3$ for indicating the operating conditions of the individual parts or paper jamming, cassette selection keys $30_4$ for alternatively selecting the upper or lower paper cassette 13 or 14, and cassette display sections $30_5$ for indicating the selected cassette. The control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Additionally arranged on the control panel 30 are operation keys 30*a*, 30*b*, 30*c* and 30*d* for shifting a spot light source (mentioned later) which serves to indicate as erasure area an unnecessary portion of the original, a position designating key 30*e* for inputting the coordinate positions indicated by the spot light source, and erasure range designating keys 30*f* and 30*g* for designating the erasure ranges in the designated positions.

Figure 4:
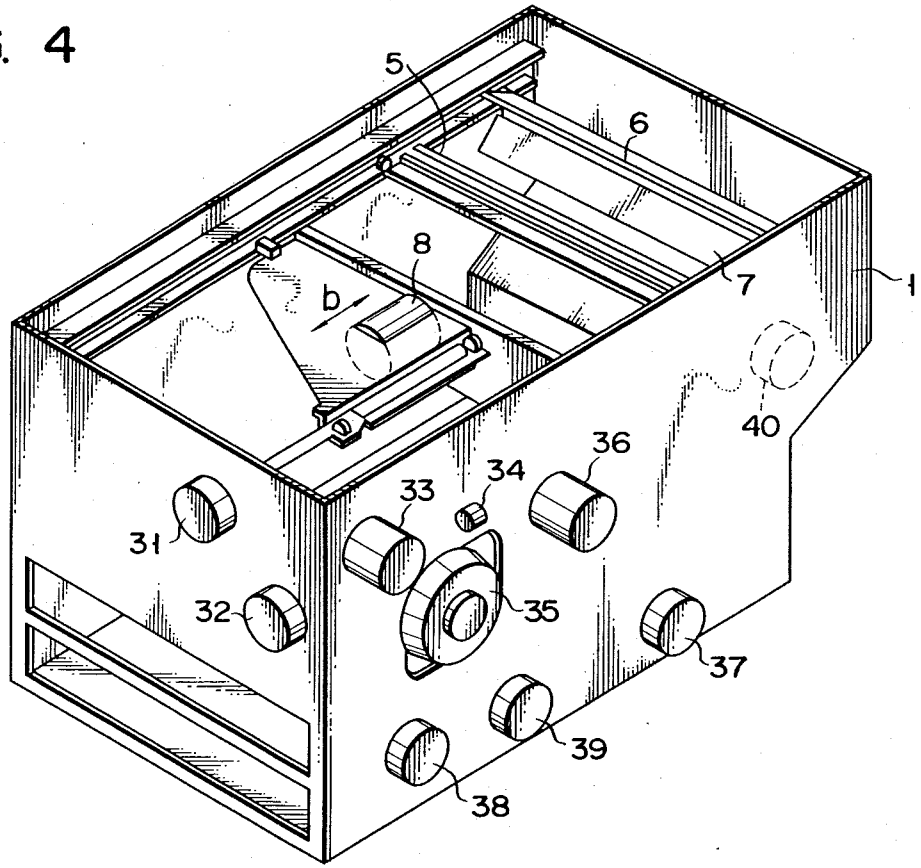

FIG. 4 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction. Numeral 32 designates a motor for mirror drive. The mirror drive motor 32 serves to change the distance (optical path length) between the mirror 5 and the mirrors 6 and 7 for magnification or reduction. Numeral 33 designates a stepping motor for scanning. The stepping motor 33 serves to move the exposure lamp 4 and the motors 5, 6 and 7 for scanning the original. Numeral 34 designates a motor for shutter drive. The shutter drive motor 34 serves to move a shutter (not shown) for adjusting the width of charging of the photosensitive drum 10 by the charger 11 at the time of magnification or reduction.

Numeral 35 designates a motor used for developing. The developing motor 35 serves to drive the developing roller and the like of the developing unit 12. Numeral 36 designates a motor used to drive the drum. The drum drive motor 36 serves to drive the photosensitive drum 10. Numeral 37 designates a motor for fixation. The fixing motor 37 serves to drive the sheet conveyor belt 22, the fixing roller pair 23, and the exit roller pair 24. Numeral 38 designates a motor for paper supply. The paper supply motor 38 serves to drive the papersupply rollers 15 and 16. Numeral 39 designates a motor for feeding sheets. The sheet feed motor 39 serves to drive the aligning roller pair 19. Numeral 40 designates a motor for fan drive. The fan drive motor 40 serves to drive the cooling fan 29.

Figure 5:
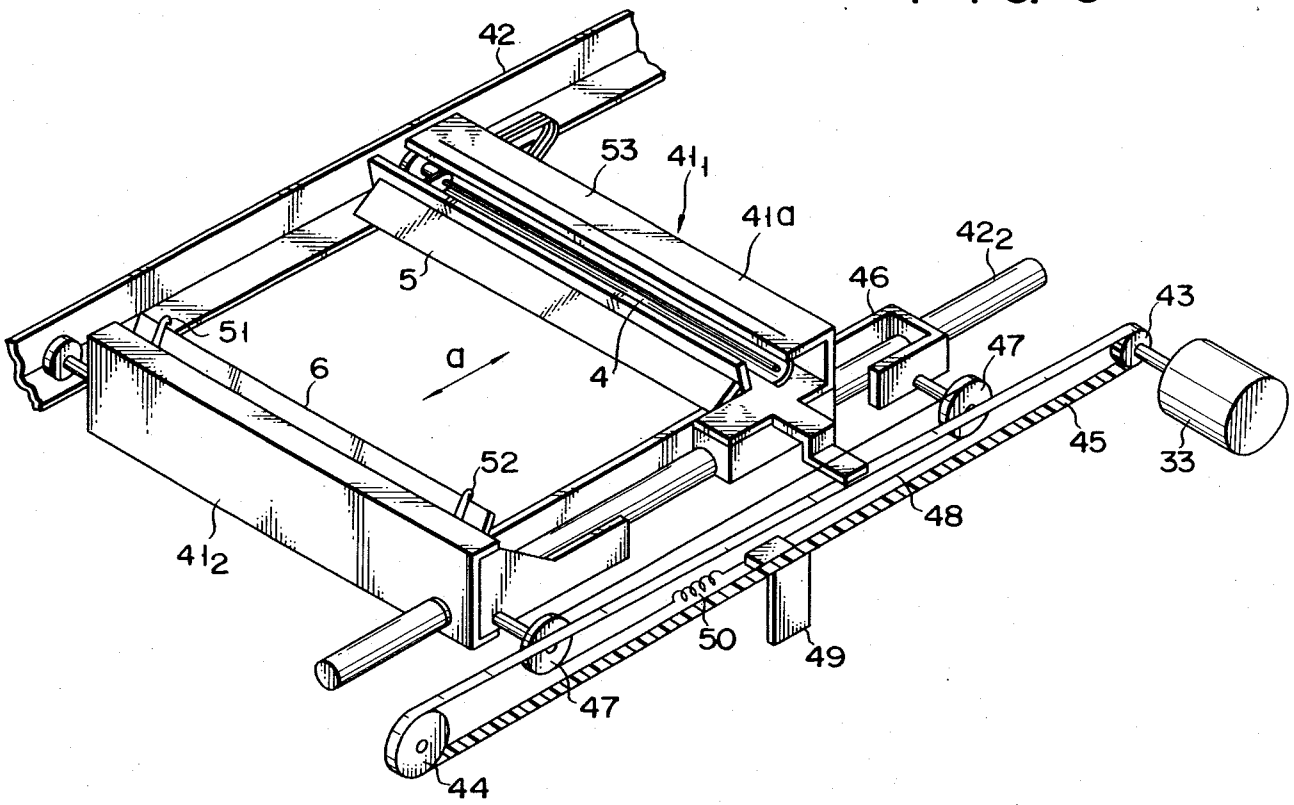

FIG. 5 shows a drive mechanism for reciprocating the optical system 3. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$. The four-phase pulse motor 33 drives a pulley 43. An endless belt 45 is stretched between the pulley 43 and an idle pulley 44, and one end of the first carriage 411 supporting the mirror 5 is fixed to the middle portion of the belt 45.

On the other hand, two pulleys 47 are rotatably attached to a guide portion 46 (for the rail 422) of the second carriage 412 supporting the mirrors 6 and 7, spaced in the axial direction of the rail $42_2$. A wire 48 is stretched between the two pulleys 47. One end of the wire 48 is connected directly to a fixed portion 49, while the other end is connected thereto by means of a coil spring 50. The one end of the first carriage 411 is fixed to the middle portion of the wire 48.

With this arrangement, when the pulse motor 33 is driven, the belt 45 turns around to move the first carriage $41_1$. As the first carriage $41_1$ travels, the second carriage $41_2$ also travels. Since the pulleys 47 then serve as movable pulleys, the second carriage $41_2$ travels in the same direction as and at a speed half that of the first carriage $41_1$. The traveling direction of the first and second carriages $41_1$ and $41_2$ is controlled by changing the rotating direction of the pulse motor 33.

The original table 2 carries thereon an indication of a reproducible range corresponding to the size of designated paper sheets. If the sheet size designated by the sheet selection keys $30_4$ and the copy ratio specified by the ratio setting keys $30_6$ or $30_7$ are (Px, Py) and K, respectively, the reproducible range (x, y) is given by $$x=Px/K,$$

$$y=Py/K.$$

Out of the coordinates (x, y) designating any point within the reproducible range, as shown in FIG. 1, the x coordinate is indicated by indexes 51 and 52 arranged on the inside of the original table 2, and the y coordinate by a scale 53 provided on the top face portion of the first carriage $41_1$.

Figure 6:
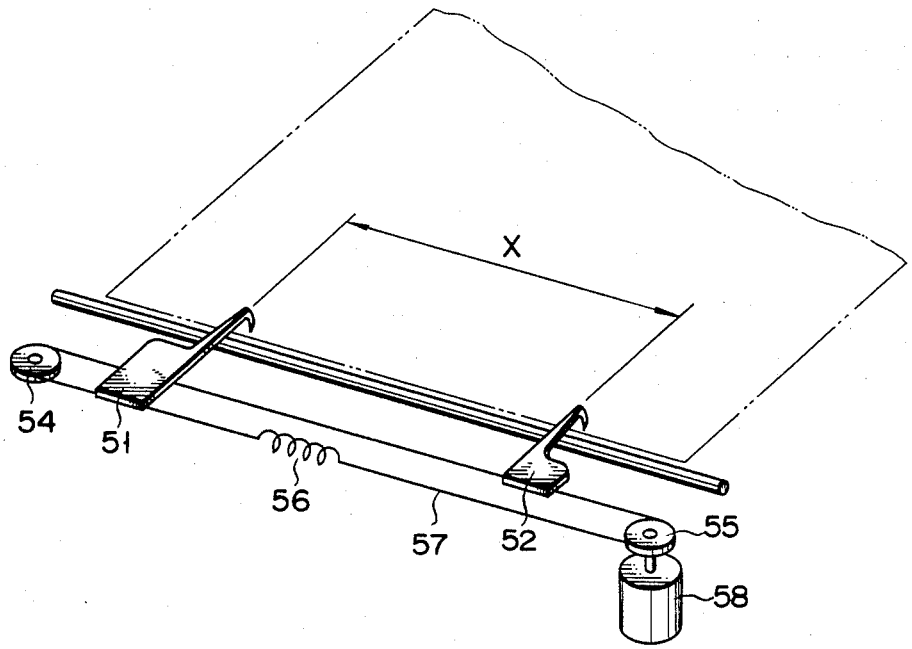

As shown in FIG. 6, the indexes 51 and 52 are attached to a wire 57 which is stretched between pulleys 54 and 55 through the aid of a spring 56. The pulley 55 is rotated by a motor 58. The distance between the indexes 51 and 52 can be changed by driving the motor 58 in accordance with the sheet size and the enlargement or reduction ratio.

The first carriage $41_1$ moves to a predetermined position (home position depending on the enlargement or reduction ratio) as the motor 33 is driven in accordance with the sheet size and the ratio. When the copy key $30_1$ is depressed, the first carriage $41_1$ is first moved toward the second carriage $41_2$. The, lamp 4 is lighted and the first carriage $41_1$ is moved away from the second carriage $41_2$. When the original scanning ends, the lamp 4 is turned off, and the first carriage $41_1$ is returned to the home position.

Figure 7:
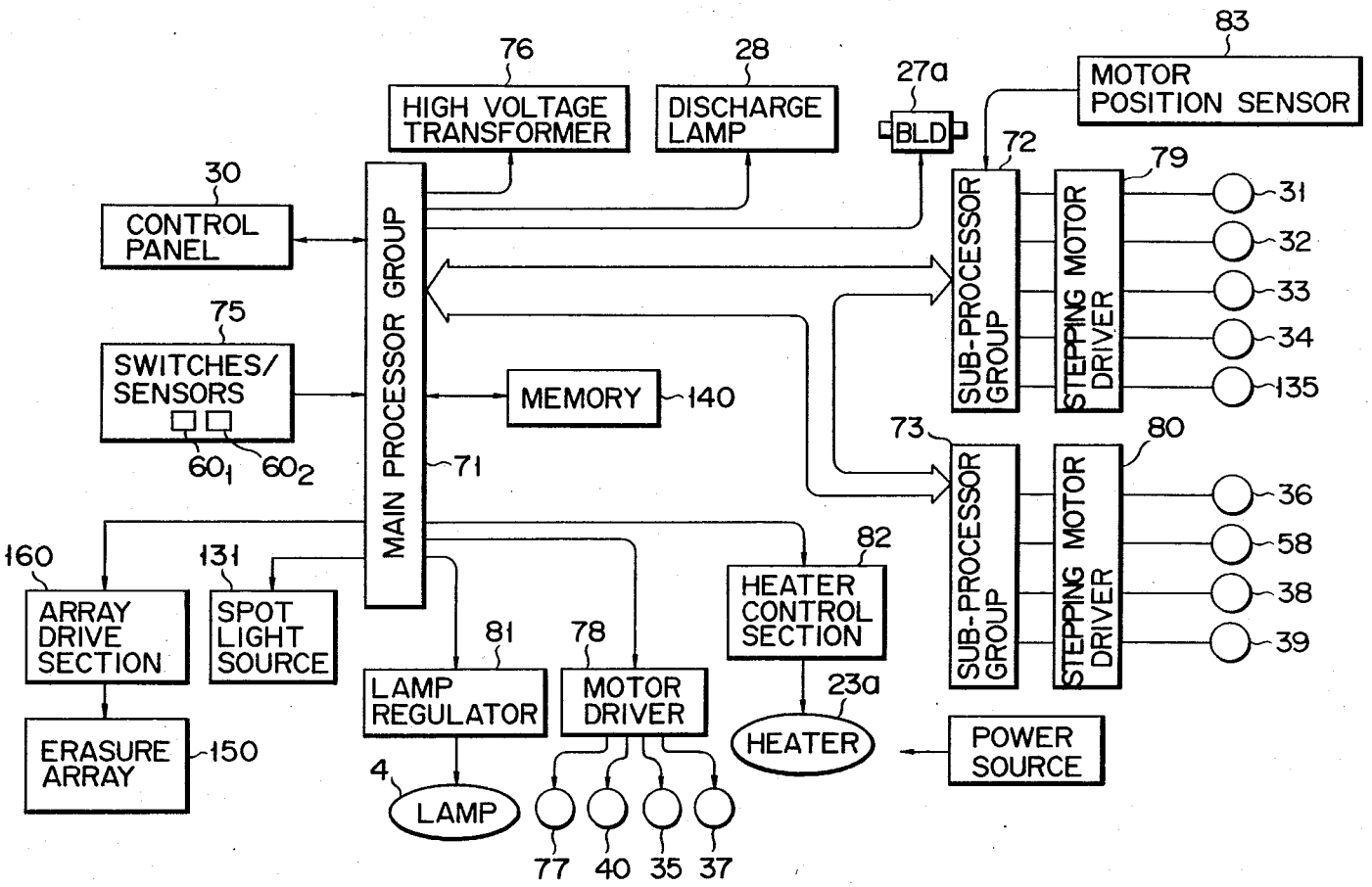

FIG. 7 shows a general control circuit of the electronic copying machine. This control circuit is mainly composed of a main processor group 71 and first and second sub-processor groups 72 and 73. The main processor group 71 detects input data from the control panel 30 and a group of input devices 75 including various switches and sensors, such as the cassette size detection switches 601 and 602' and controls a high-voltage transformer 76 for driving the chargers, the discharge lamp 28, a blade solenoid **27*a* of the cleaner 27, a heater 23*a* of the fixing roller pair 23, the exposure lamp 4, and the motors 31 to 40 and 58, thus accomplishing the copying operation. The main processor group 71 also controls a spot light source 131, a pulse motor 135, an erasure array 150, an array drive section 160, and a memory 160, thereby erasing any unnecessary portions of the original. These components 131, 135, 150, 160 and 140** will be described in detail later.

The motors 35, 37 and 40 and a toner-supply motor 77 for supplying the toner to the developing unit 12 are connected through a motor driver 78 to the main processor group 71 to be controlled thereby. The motors 31 to 34 and 95 are connected through a stepping motor driver 79 to the first subprocessor group 72 to be controlled thereby. The motors 36, 38, 39 and 58 are connected through a stepping motor driver 80 to the second subprocessor group 73 to be controlled thereby.

Further, the exposure lamp 4 is controlled by the main processor group 71 through a lamp regulator 81, and the heater **23*a* by the main processor group 71 through a heater control section 82. The main processor group 71 gives instructions for the start or stop of the individual motors to the first and second sub-processor groups 72 and 73. Thereupon, the first and second subprocessor groups 72 and 73 feed the main processor group 17 with status signals indicative of the operation mode of the motors. Also, the first sub-processor group 72 is supplied with positional information from a position sensor 83 for detecting the respective initial positions of the motors 31 to 34**.

Figure 8:
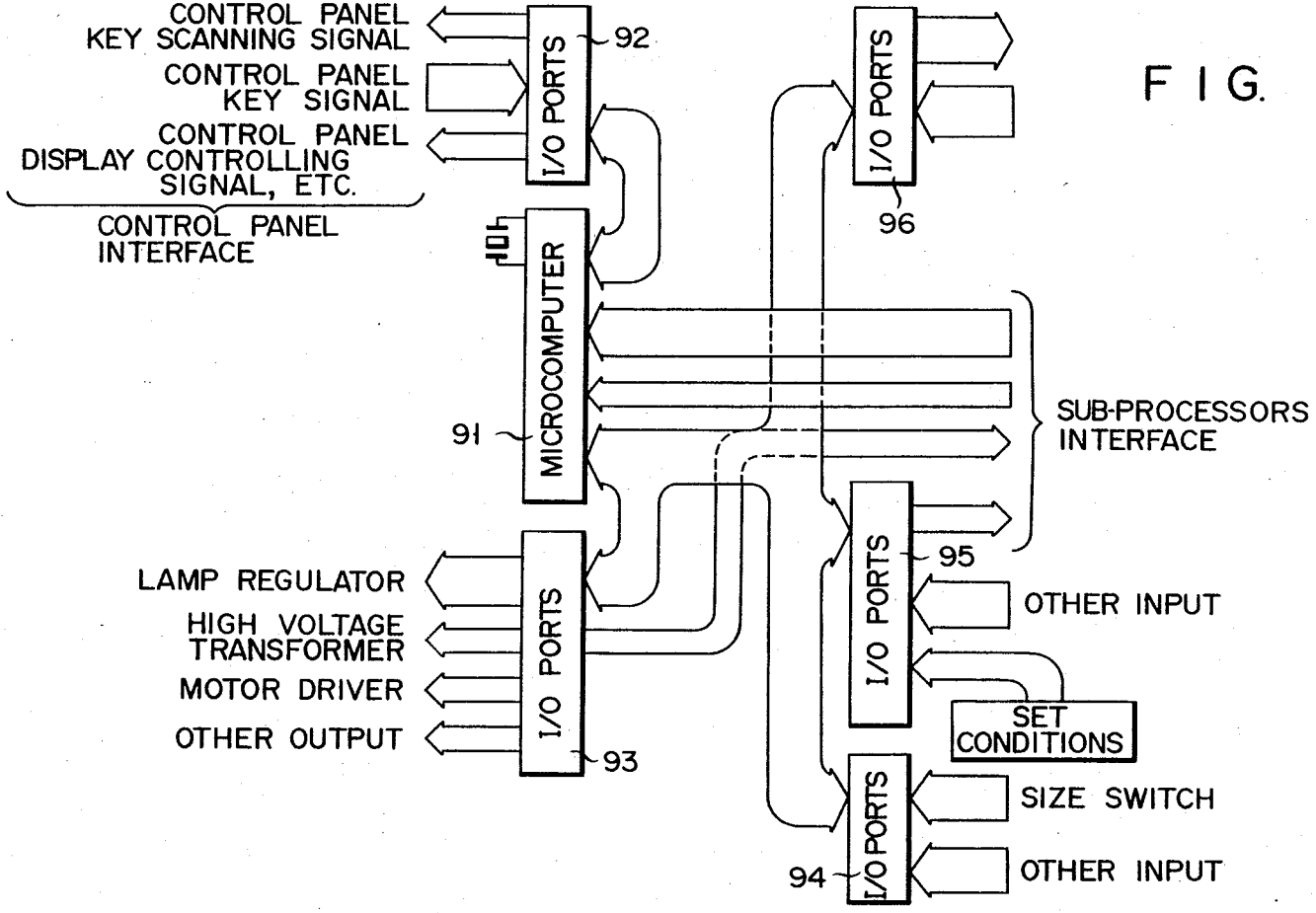

FIG. 8 shows an arrangement of the main processor group 71. Reference numeral 91 denotes a one-chip microcomputer (to be referred to as a CPU hereinafter). The CPU 91 detects key inputs at a control panel (not shown) through an I/O port 92 and controls display operations. The CPU 91 can be expanded through I/O ports 93 to 96. The port 93 is connected to a high-voltage transformer 76, a motor driver 78, a lamp regulator 81 and other outputs. The port 94 is connected to a size switch for detecting a paper size and other inputs. The port 95 is connected to a copying condition setting switch and other inputs. The port 96 is optional.

Figure 9:
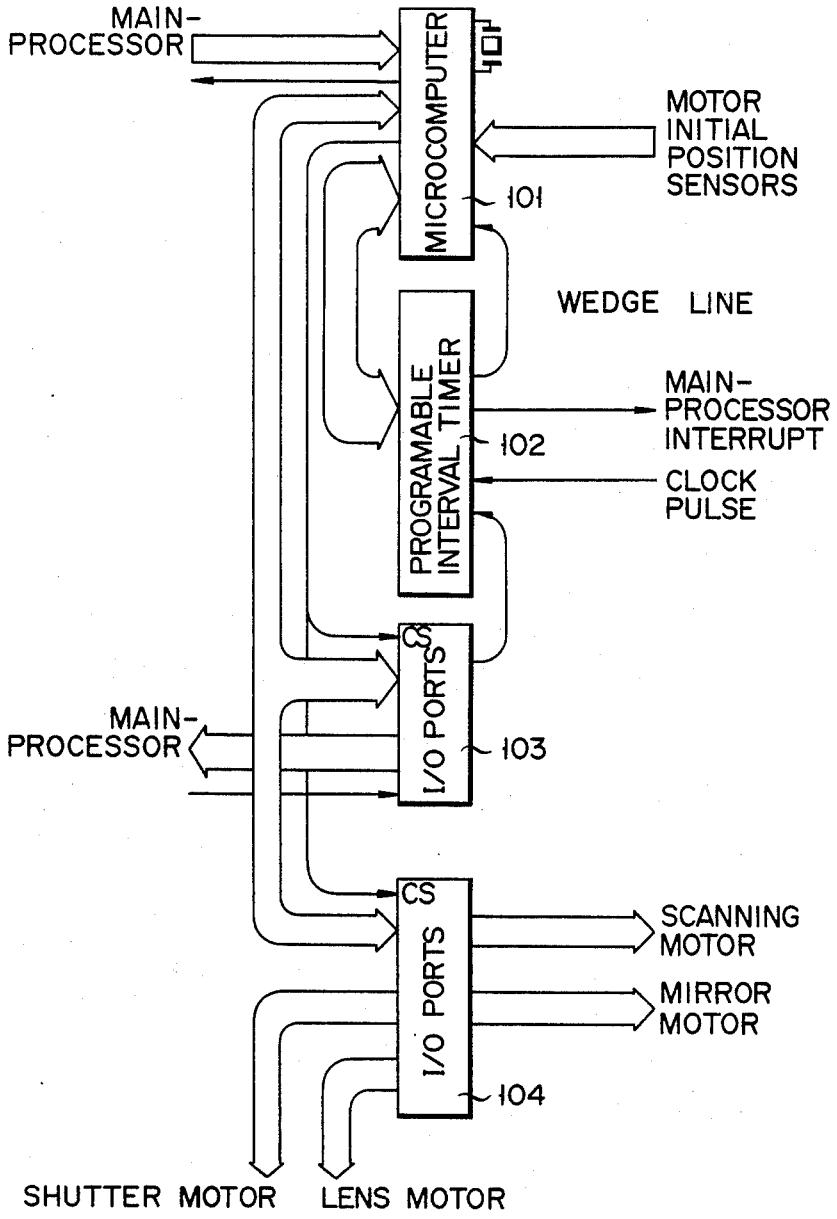

FIG. 9 shows an arrangement of the first subprocessor group 72. Reference numeral 101 denotes a CPU connected to the group 71. Reference numeral 102 denotes a programable interval timer for controlling switching time intervals. A preset value from the CPU 101 is set in the programable interval timer, and the timer is started. When the timer is stopped, the timer sends an end pulse onto an interrupt line of the CPU 101. The timer 102 receives a reference clock pulse. The CPU 101 receives position data from a position sensor 83 and is connected to I/O ports 103 and 104. The port 104 is connected to motors 31 to 34 and 135 through the stepping motor driver 79. The port 103 is used to supply a status signal from each pulse motor to the group 71.

Figure 10:
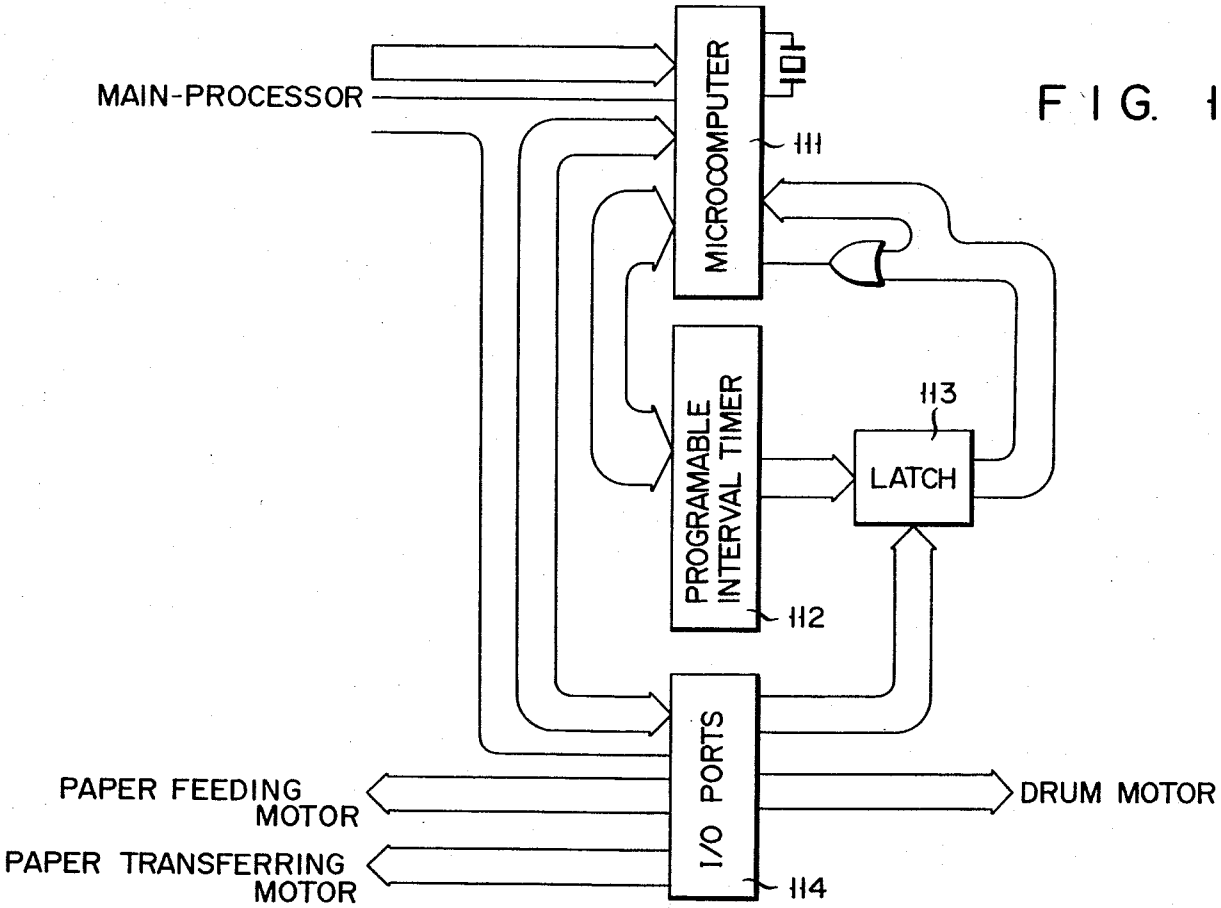

FIG. 10 shows an arrangement of the second subprocessor group 73. Reference numeral 111 denotes a CPU connected to the group 71. Reference numeral 112 denotes a programable interval timer for controlling switching time intervals of the pulse motors. A preset value from the CPU 111 is set in the programable interval timer, and the timer is started. When the timer is stopped, it generates an end pulse. The end pulse is latched by a latch 113, and an output therefrom is supplied onto the interrupt line of the CPU 111 and the input line of the I/O port. The CPU 111 is connected to an I/O port 114 which is then connected to motors 36, 38, 39 and 58 through the driver 80.

FIG. 11 shows a pulse motor control circuit. An I/O port 121 (corresponding to the ports 104 and 114 of FIGS. 8 and 9) is connected to a stepping motor driver 122 (corresponding to the drivers 79 and 80 of FIG. 6). The driver 122 is connected to windings A, $\overline{A}$, B and $\overline{B}$ of a stepping motor 123 (corresponding to the motors 31 to 34, 36, 38 and 39).

FIGS. 12A and 12B show a method of controlling a stepping motor speed. FIG. 12A shows a stepping motor speed curve, and FIG. 12B shows switching intervals. As is apparent from FIGS. 12A and 12B, the switching intervals are long at the beginning, are gradually decreased, and finally stop to decrease. Then, the intervals are prolonged, and the stepping motor is finally stopped. This cycle indicates the through-up and through-down of the pulse motor. The motor is started from the self starting region, operated in a high-speed region and is gradually stopped. Reference symbols $t_1$, $t_2$, . . . $t_x$ denote times between the switching intervals.

Indicating means and erasing means according to the present invention will now be described in detail.

Figure 13:
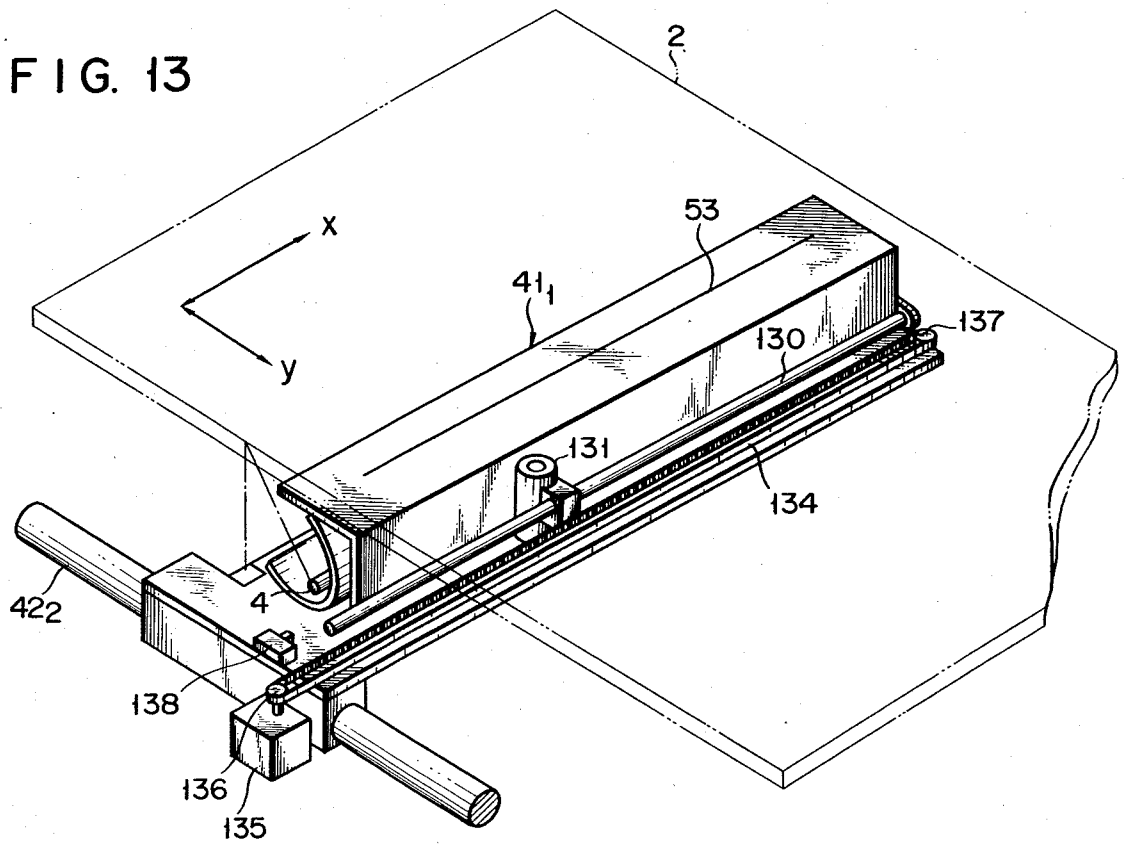
Figure 14:
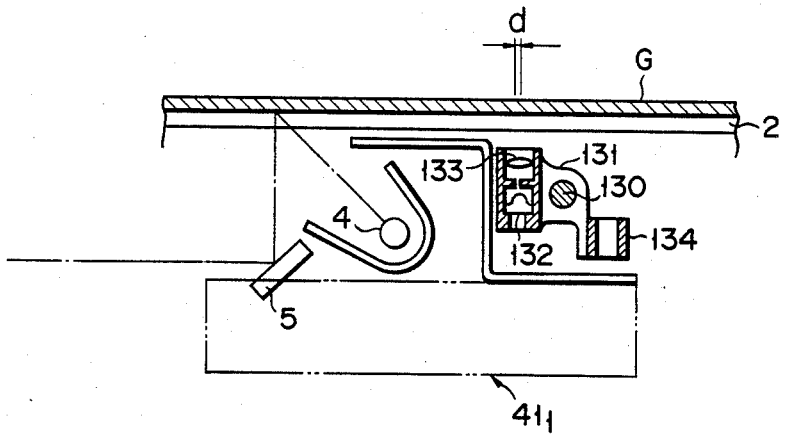

In FIGS. 13 and 14, a guide shaft 130 is disposed at that portion of the first carriage $41_1$ intercepting the light from the lamp 4, extending along the lamp 4. The guide shaft 130 is movably fitted with the spot light source 131 as the indicating means for indicating an erasure range of the original. As shown in FIG. 14, the spot light source 131 includes a light emitting element 132, such as a light emitting diode or lamp, and a lens 133 which are opposed to the original table 2.

A light beam emitted from the light emitting element 132 is applied to the original table 2 through the lens 133, as a spot light with a diameter d of, e.g., 2 mm. The spot light has enough brightness to be transmitted through an original G as thick as, e.g., a postcard set on the original table 2. The spot light source 131 is coupled to a timing belt (toothed belt) 134 extending along the guide shaft 130. The timing belt 134 is stretched between a pulley 136 mounted on the shaft of the stepping motor 135 and a driven pulley 137. As the stepping motor 135 is rotated the spot light source 131 is moved in a direction perpendicular to the scanning direction of the first carriage $41_1$.

A position sensor 138 formed of a microswitch for detecting the initial position of the spot light source 131 is attached to that portion of the first carriage $41_1$ which is located beside the end portion of the guide shaft 130 on the side of the stepping motor 135. When the spot light source 131 is moved, for example, it first abuts against the position sensor 134 to have its initial position detected thereby.

Figure 15:
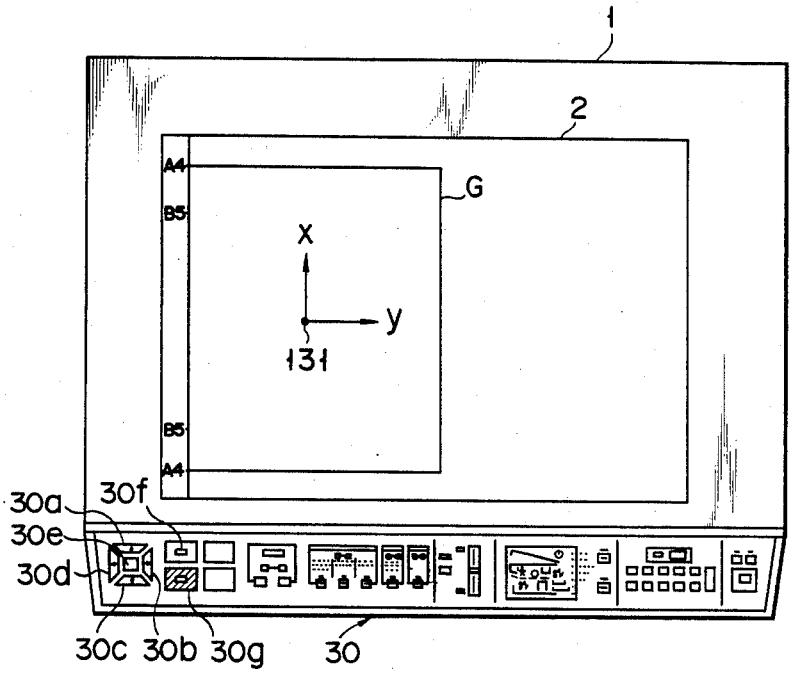
Figure 16:
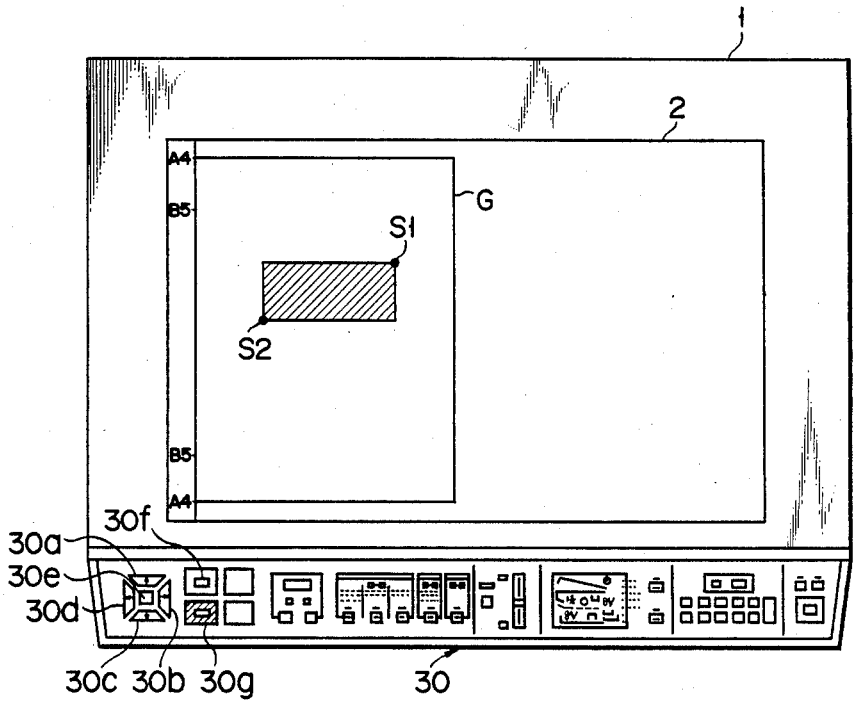
Figure 17:
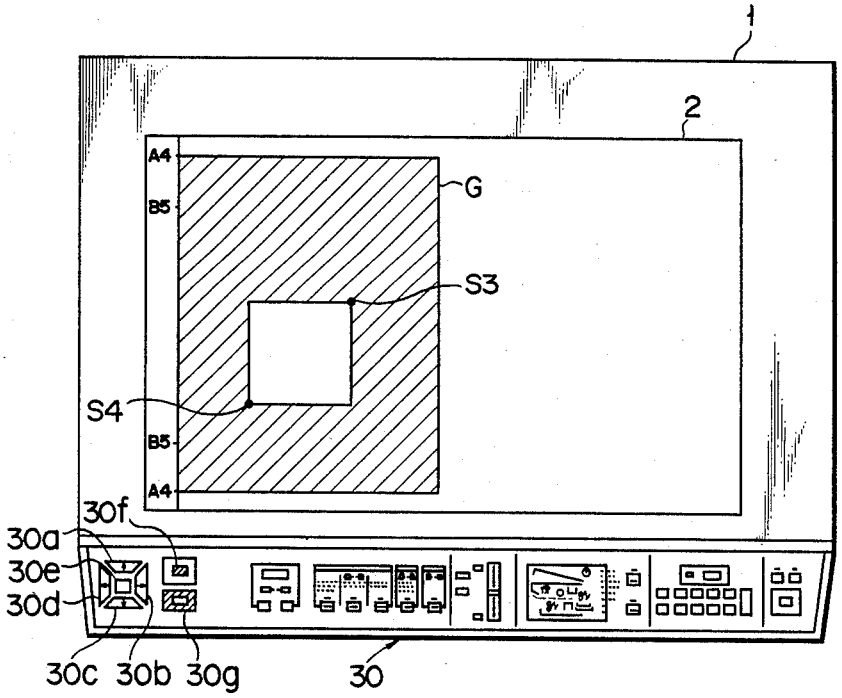

Referring now to FIGS. 15 to 17, there will be described a method for designating the erasure range of the original by means of the spot light source 131.

The spot light source 131 is moved by operating the operation keys 30*a* to 30*d*. In this case, the orignal G is set on the orignal table 2 to upward a copying surface. When the operation keys 30*b* and 30*d* are depressed, the motor 33 is started, and the first carriage $41_1$ and the spot light source 131 are moved in the scanning direction (indicated by arrow y in FIG. 15). When the operation keys 30*a* and 30*c* are depressed, on the other hand, the motor 135 is started, and the spot light source 131 is moved in a direction (indicated by arrow x in FIG. 15) perpendicular to the scanning direction.

Observing the spot light transmitted through the original G, the operator operates the operation keys 30*a* to 30*d*. When the spot light reaches, for example, a spot S1 on the original G shown in FIG. 16, the operator depresses the position designating key 30*e*. Thereupon, the coordinate position indicated by the spot S1 is stored in the main processor group 71 shown in FIG. 7. Likewise, if the position designating key 30*e* is depressed when a spot S2 on the original G is reached by the spot light, the position of the spot S2 is stored in the main processor group 71. This position of the spot light can be detected by, for example, counting drive pulses delivered from the stepping motors 33 and 135. When the erasure range designating key 30*f* is depressed thereafter, a rectangular region (hatched region) having its two opposite vertexes on the spots S1 and S2 is designated as the erasure range, as shown in FIG. 16.

If the erasure range designating key 30*g* is depressed after designating spots S3 and S4 on the original G, the other region of the original G (i.e. not a square region having its two opposite vertexes on the spots S3 and S4) is designated as the erasure range, as shown in FIG. 17. Thus, if the erasure range designating key 30*f* or 30*g* is depressed, the main processor group 71 executes calculation in accordance with the positions of the two designated spots, and high- and low-level signals "1" and "0" are stored in those addresses of the memory 140 for the erasure range and the remaining region, respectively.

For example, the memory 140 is formed of a RAM whose capacity in the direction of each column is substantially equal to a value obtained by dividing the moved distance of the spot light source 131 in the x direction by the positional resolution in the x direction, and whose capacity in the direction of each row is substantially equal to a value obtained by dividing the moved distance of the spot light source 131 in the y direction by the positional resolution in the y direction. In the case of FIG. 16, high- and low-level signals are stored in those addresses of the memory 140 for the hatched region and the other region, respectively, based on data supplied from the main processor group 71.

Figure 18:
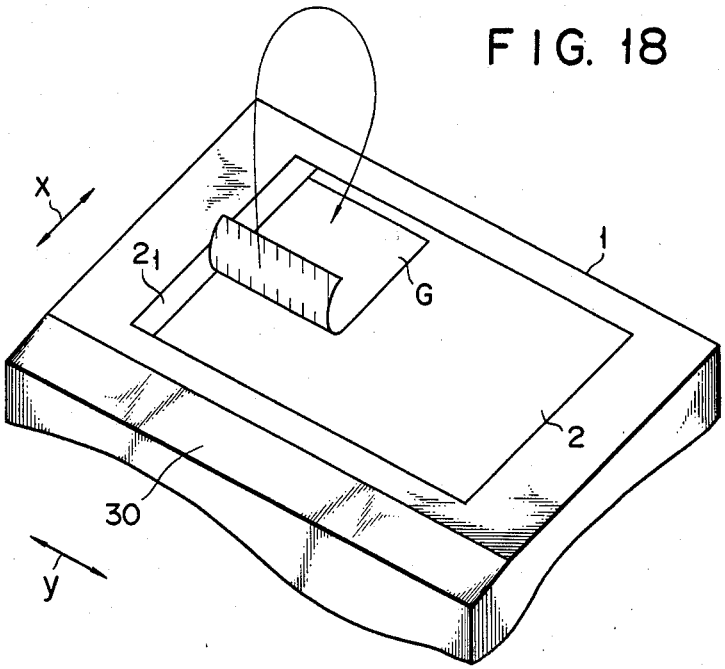

After the erasure range is specified, the origianl G on the table 2 is turned over in the x direction along the scale $2_1$, as shown in FIG. 18. Therefore, the position data along the x direction is different in the position specifying and copying modes, but the position data along the y direction does not change.

Figure 20:
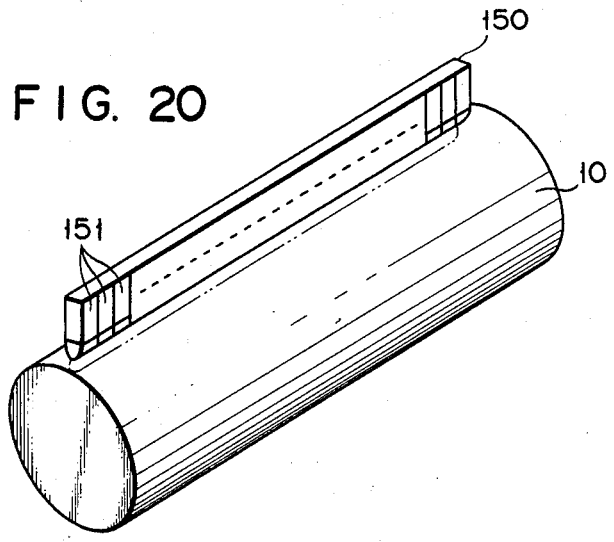
Figure 19A:
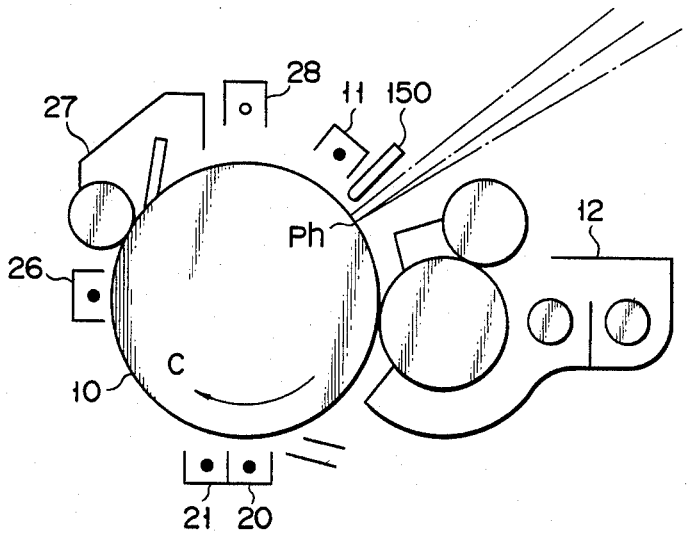
FIG. 19A is a side sectional view of the principal part showing an arrangement of the erasure array.
Figure 21:
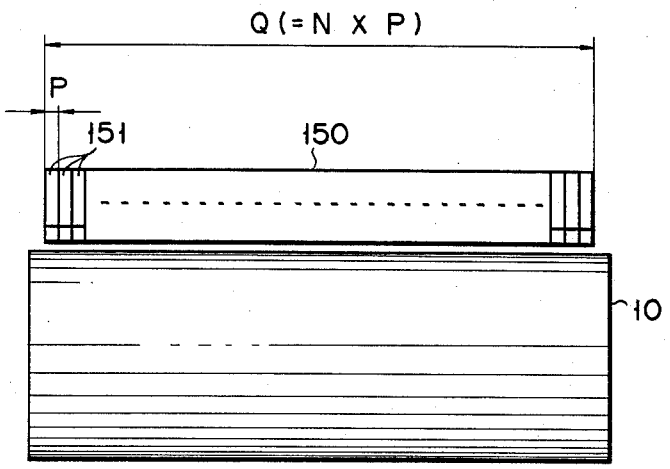
Figure 22A:
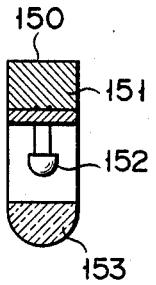
FIG. 22A is a side sectional view of the erasure array.
Figure 22B:
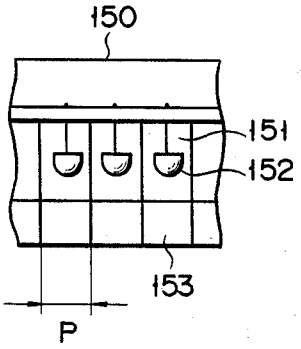
FIG. 22B is a partial front view of the erasure array.

As shown in FIG. 19A, on the other hand, the erasure array 100 as the erasing means is disposed close to the photosensitive drum 10, between the charger 11 and an exposure region Ph, for example. As shown in FIGS. 20 and 21, the erasure array 150 includes a plurality of shading cells 151 which are arranged in a direction perpendicular to the rotating direction of the photosensitive drum 10. As shown in FIGS. 22A and 22B, the cells 151 each contains therein a light emitting element 152 formed of, e.g., a light emitting diode. Moreover, a lens 153 for converging light from the light emitting element 152 on the surface of the photosensitive drum 10 is disposed at the opening portion of each cell 151 facing the photosensitive drum 10.

The number of light emitting elements 152 arranged in the erasure array 150 is equivalent to, for example, the column-direction capacity of the memory 140. If the distance between each two adjacent light emitting elements 152 and the number of light emitting elements 152 are P and N, respectively, the overall length Q of the erasure array 100 is $Q=N\times P$.

Figure 23:
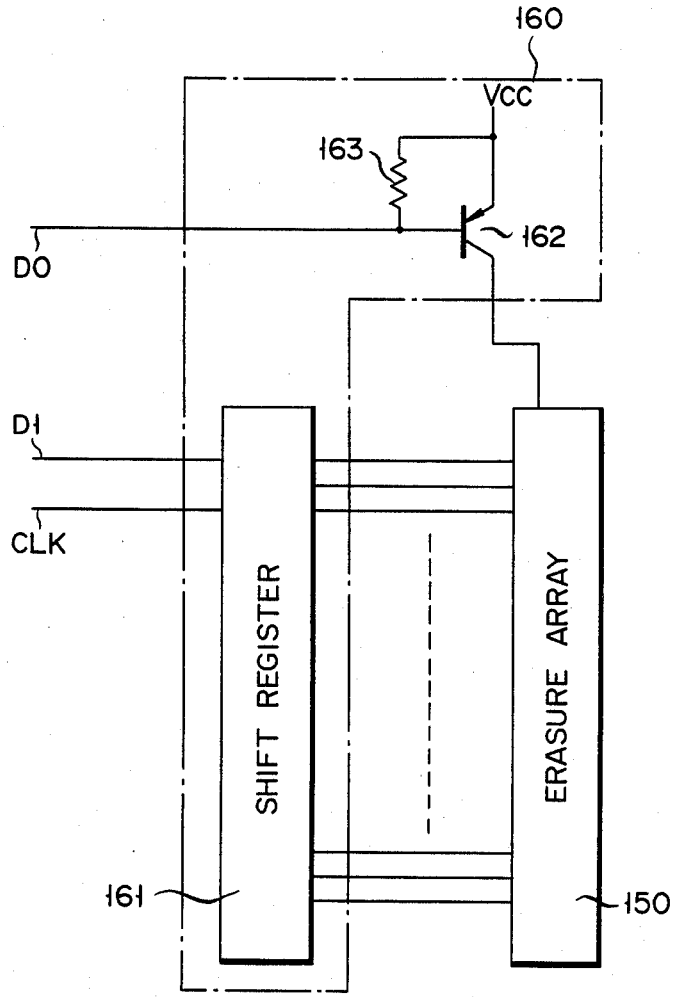
Figure 24A:
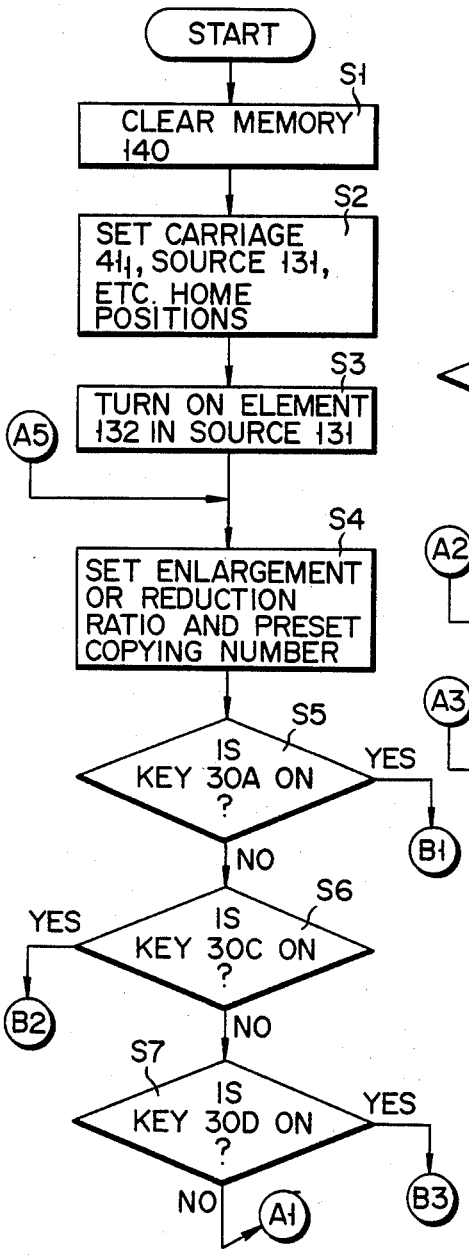
Figure 24B:
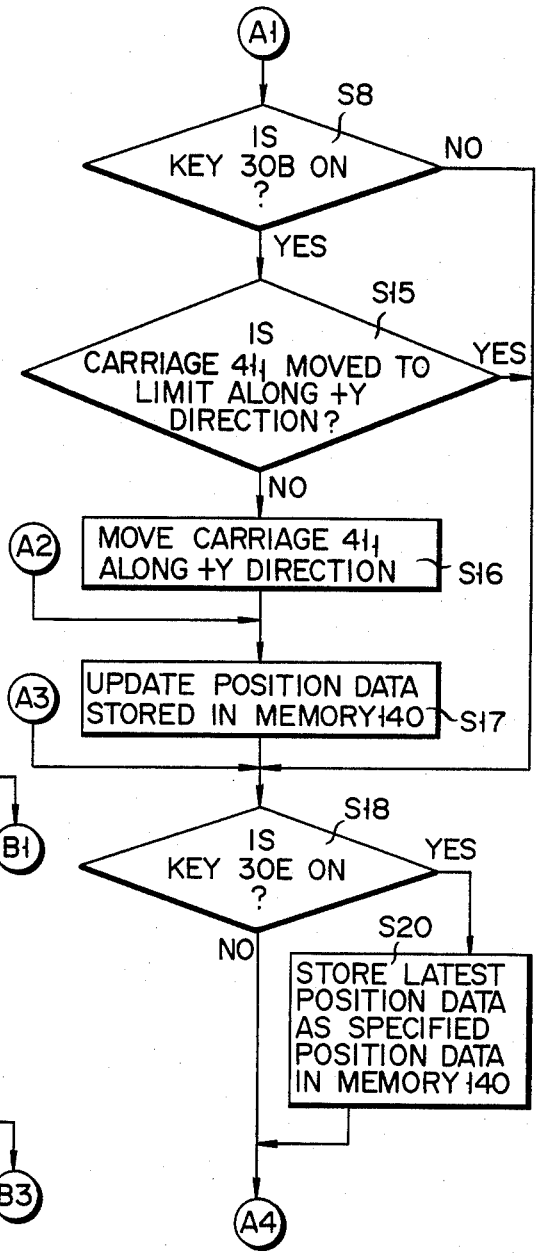
Figure 24C:
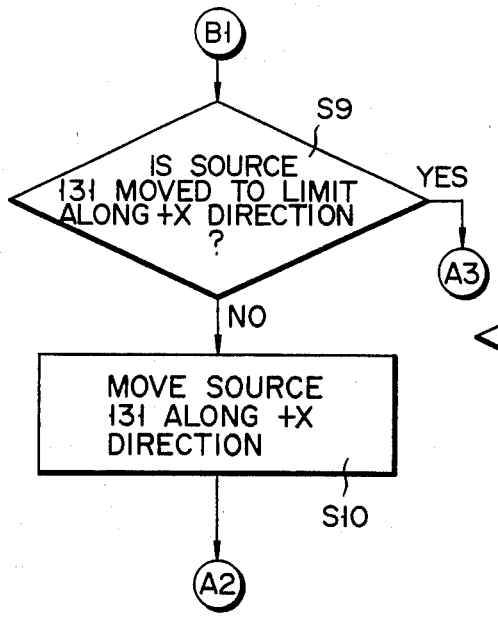
Figure 24D:
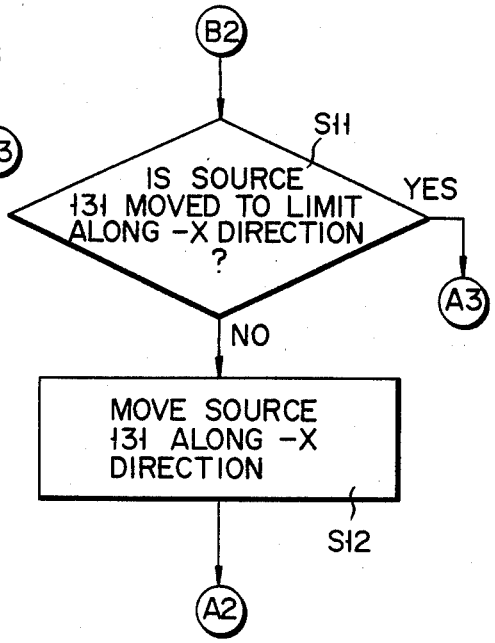
Figure 24E:
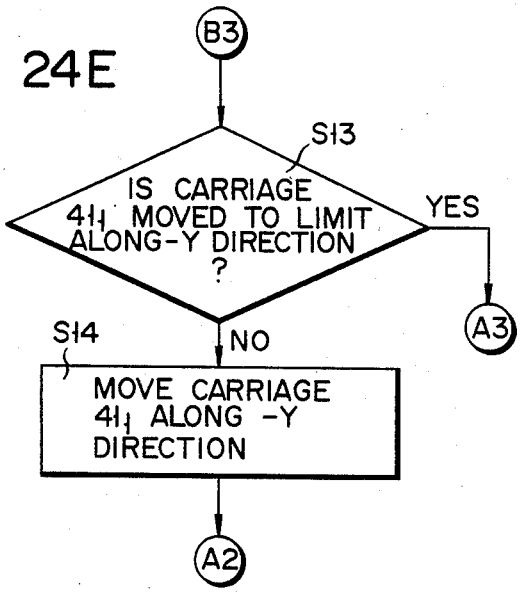
Figure 24F:
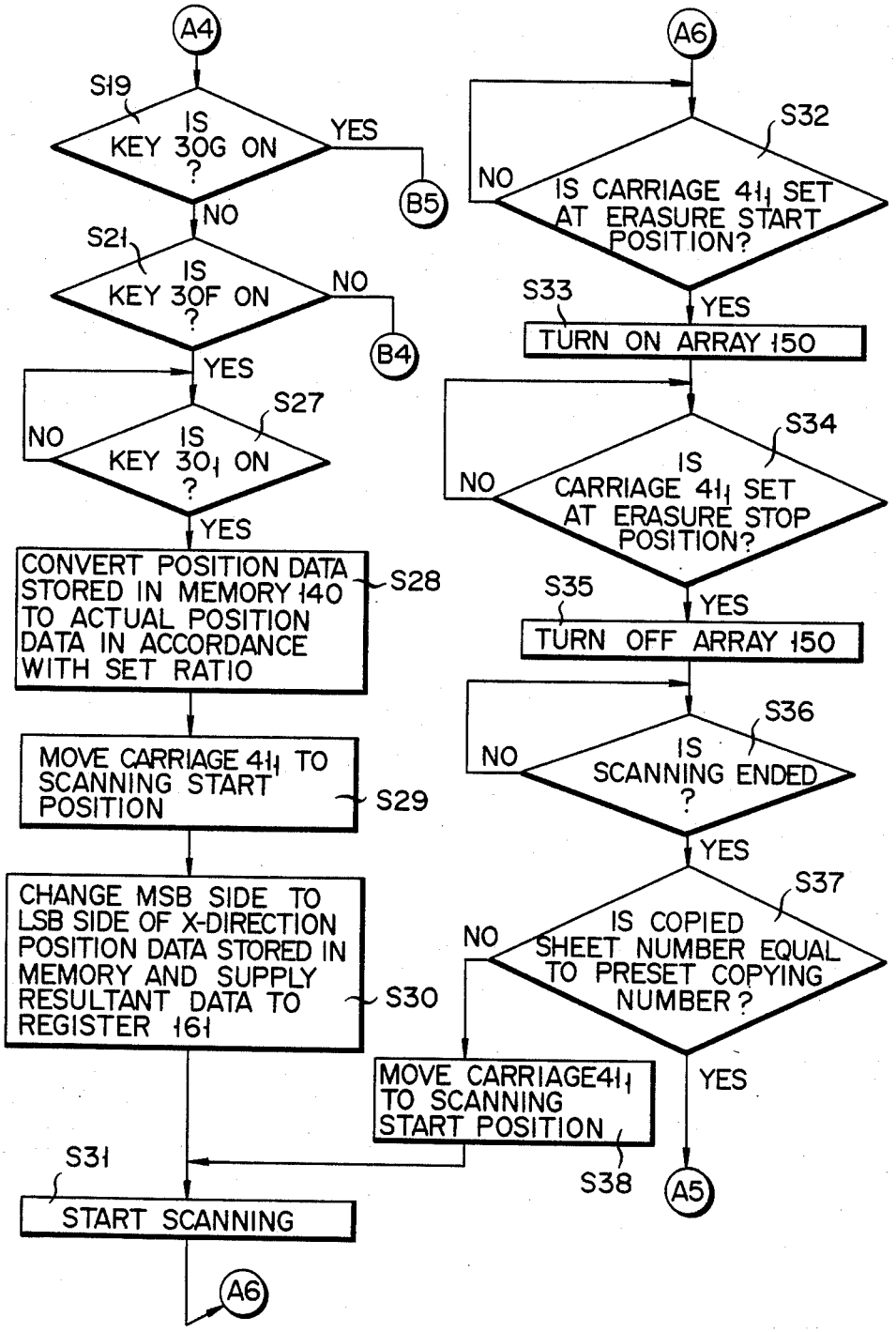
Figure 24G:
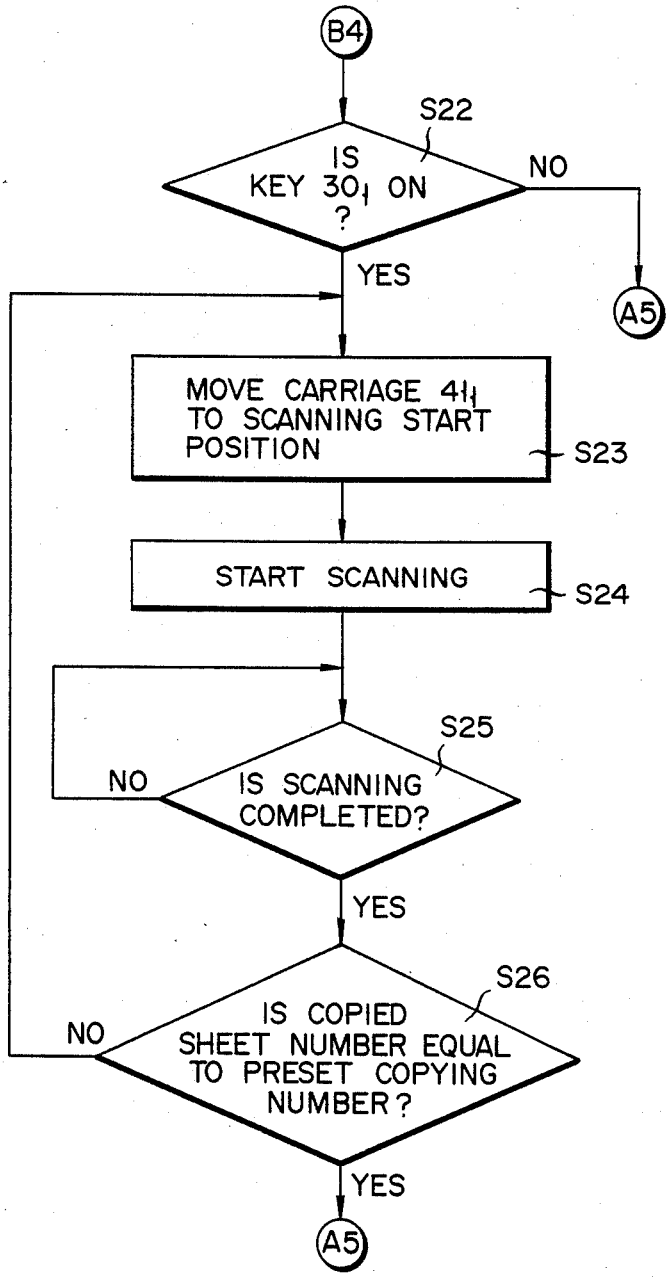
Figure 24H:
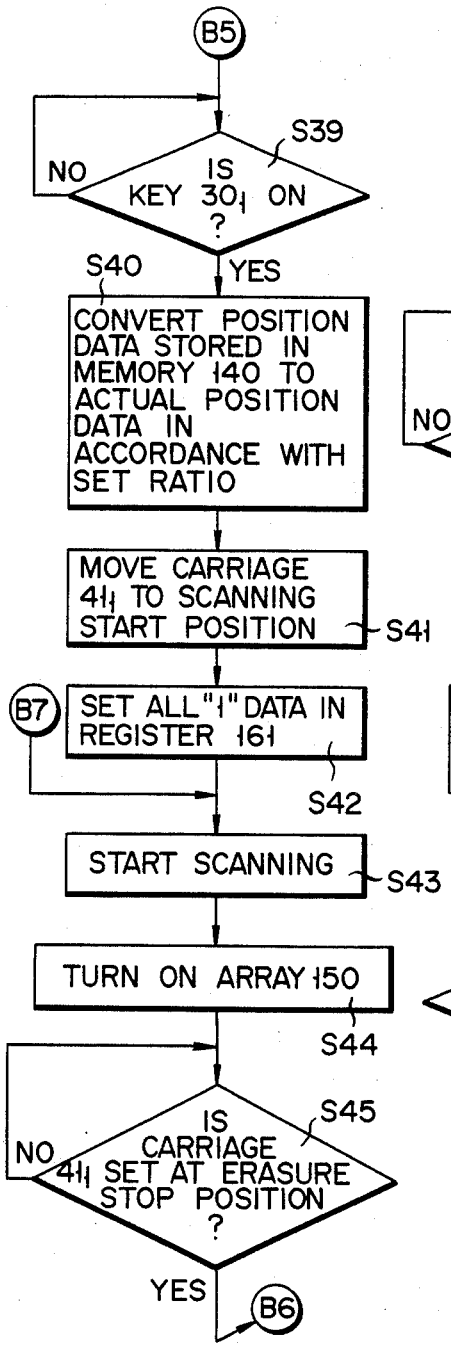
Figure 24I:
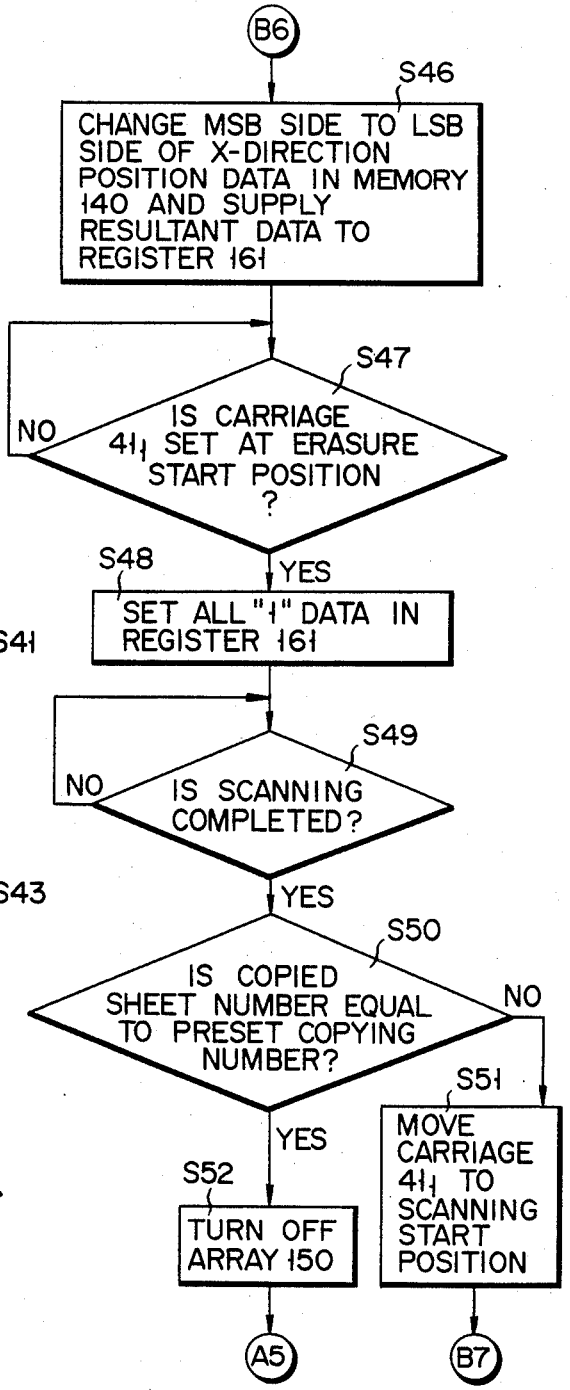

The erasure array 150 is driven by an array driving section 160. As shown in FIG. 23, the section 160 comprises a shift register 161, output terminals of which are respectively connected to the elements 152 in the section 160, a transistor 162 which is turned on in response to an ON control signal D0 supplied from the group 71 and which supplies power to the respective elements 152 of the array 150, and a bias resistor 163 for the transistor 162.

With the arrangement described above, the erasure operation of the original image will be described with reference to flow charts of FIGS. 24A to 24I.

When the power switch on the housing 1 is turned on, the memory 140 is cleared in step S1. The carriage $41_1$ and the source 131 are energized in step S2, and initialization is performed by using position detection data of the carriage $41_1$ and the spot light source 131. Thereafter, in step S3, the elements 132 in the source 131 are turned on. In step S4, an enlargement or reduction ratio and a preset copying number entered at the operation panel 30 are fetched by the CPU. In this state, the CPU sequentially checks in steps S5 to S8 whether or not the keys 30*a* to 30*d* are depressed. If YES in step S5, the flow advances to step S9. The CPU checks in step S9 whether or not the source 131 is moved to the limit along the +x direction (i.e., a direction to separate from the switch 138). When the source 131 is already moved to the limit, the flow advances to step S18 (to be described later). However, if NO in step S9, the source 131 is moved along the +x direction in step S10. Thereafter, the flow advances to step S17.

If YES in step S6, the flow advances to step S11. The CPU checks in step S11 whether or not the source 131 is moved to the limit along the −x direction, (a direction toward the switch 138), i.e., whether or not the switch 138 is turned on. If YES in step S11, the flow advances to step S18. However, if NO in step S11, the source 131 is moved along the −x direction in step S12. Thereafter, the flow advances to step S17 (to be described later).

If YES in step S7, the flow advances to step S13. The CPU checks in step S13 whether or not the source 131 is moved along the −y direction (i.e., a direction toward the scale $2_1$). If YES in step S13, the flow advances to step S18. However, if NO in step S13, the flow advances to step S14. The carriage $41_1$ is moved along the −y direction, and thereafter the flow advances to step S17.

If YES in step S8, the flow advances to step S15. The CPU checks in step S15 whether or not the source 131 is moved to the limit along the +y direction (i.e., a direction to separate from the scale $2_1$). If YES in step S15, the flow advances to step S18. However, if NO in step S15, the carriage $41_1$ is moved along the +y direction in step S16.

When the carriage $41_1$ and the source 131 are moved as described above, position data of the source 131 are sequentially stored in the memory 140 in step S17. The memory 140 is divided into, for example, first and second memory areas. The position data are sequentially stored in the first memory area. The contents of the first memory area are sequentially updated. The CPU checks in step S18 whether or not the key 30*e* is depressed. If NO in step S18, the flow advances to step S19. However, if YES in step S18, the latest data among the position data stored in the first memory area of the memory 140 is stored as specified position data S(x,y) in the second memory area of the memory 140. Thereafter, the flow advances to step S19. The CPU checks in steps S19 and S21 whether or not the keys 30*g* and 30*f* are depressed. When the CPU determines that no keys are depressed, the flow advances from step S21 to S22. Normal copying operation is performed in steps S22 to S26. More particularly, in step S22, the CPU checks whether or not the key $30_1$ is depressed. If NO in step S22, the flow advances to step S4. When the CPU determines that only the key $30_1$ is depressed, the carriage $41_1$ is moved to the scanning start position in step S23. In step S24, the lamp 4 is turned on, the drum 10 is driven, and scanning is started. The CPU checks in step S25 whether or not scanning is completed. If YES in step S25, the CPU checks in step S26 whether or not the preset copying number is the same as the copied sheet number. If NO in step S26, the flow returns to step S23. However, if YES in step S26, the flow returns to step S4.

When the CPU determines in step S21 that the key 30*f* is turned on, the CPU checks in step S27 whether or not the key $30_1$ is depressed. If YES in step S27, the position data stored in the second memory area in the memory 140 is converted to actual position data in accordance with the set ratio. The actual position data xact is given as follows when the original is set at the center of the scale $2_1$ along the x direction:

$$x_{act}=lx/2+(x-lx/2)/K$$

where lx is the length of the table 2 along the x direction, K is the set ratio, and x is the specified position data along the x direction. The y-direction position data need not be converted. However, since a distance between the array 150 and the exposure portion Ph is given as ld, the distance ld is multiplied with the ratio K to obtain a proper ON timing of the array 150.

After the stored position data is converted to the actual position data, the carriage $41_1$ is moved to the scanning start position in step S29. In step S30, the ON data is supplied from the array 150 to the register 161. Among the converted position data, data D1 is generated such that two x-direction position data representing one side of a specified rectangle is set at logic "1", and other data are set at logic "0". All bits of the data D1 are reversed such that the LSB is converted to the MSB and higher bits to lower bits so as to match with the turned-over original. The resultant data D1 is transferred to the register 161 in the section 160 of FIG. 23 in response to a clock signal CLK. In this state, the lamp 4 is turned on in step S31, and the drum 10 is driven, so that scanning is started. The CPU checks in step S32 whether or not the shifted position of the carriage $41_1$ is the erasure starting position in accordance with the y-direction converted position data. If YES in step S32, the array 150 is turned on in step S33. The signal D0 is supplied to the transistor 162 shown in FIG. 23. The transistor 162 is turned on and power is supplied to the array 150. The elements 152 which correspond to the data of high level of the register 161 are turned on, and a corresponding portion of the drum 10 is discharged. For this reason, the discharged portion will not have the latent image even if it is exposed with light, thereby erasing the original image portion.

Thereafter, the CPU checks in step S34 whether or not the shifted position of the carriage $41_1$ is the erasure stop position in accordance with the y-direction position data. If YES in step S34, the array 150 is turned off in step S35. The signal D0 supplied to the transistor 162 is disabled, and the transistor 162 is turned off. The array 150 is deenergized. The CPU checks in step S36 whether or not the carriage $41_1$ is moved to a predetermined scanning range. If YES in step S36, the CPU checks in step S37 whether or not the preset copying number is equal to the copied sheet number. If NO in step S37, the flow advances to step S38. In step S38, the carriage $41_1$ is moved to the scanning start position, and the flow returns to step S31. The operation described above is repeated. However, if YES in step S37, the flow returns to step S4. As shown in FIG. 16, an image from which a hatched portion of the original G is omitted can be formed.

When the CPU determines in step S19 that the key 30*g* is depressed, the CPU checks in step S39 whether or not the key $30_1$ is depressed. If YES in step S39, the position data stored in the second memory area in the memory 140 is converted to actual position data in accordance with the set ratio in step S40 in the same manner as in step S28. In step S41, the carriage $41_1$ is moved to the scanning start position. In step S42, data D1 consisting of all logic "1" is generated. The resultant data D1 is transferred to the section 160 of FIG. 23 in response to the clock signal CLK. The lamp 4 is turned on in step S43, the drum 10 is driven, and scanning is thus started. The signal D0 is supplied to the transistor 162 in the section 160 of FIG. 23 in step S44, so that the transistor 162 is turned on. For this reason, power is supplied to the array 150, and all the elements 152 in the array 150 are turned on. The corresponding portion of the drum 10 is discharged. Therefore, no latent image is formed on the discharged portion of the drum, thereby performing erasure of an unnecessary portion of the original image.

The CPU checks in step S45 whether or not the moved position of the carriage $41_1$ is the erasure stop position in accordance with the converted y-direction position data. If YES in step S45, the flow advances to step S46 wherein the erasure data is supplied to the register 161 in the section 160. More particularly, the group 71 generates data D1 consisting of two x-direction position data of low level, i.e., logic "0" representing one side of the rectangle and other data of high level, i.e., logic "1". All bits of the data D1 are reversed such that the LSB is converted to the MSB and higher bits to lower bits so as to match with the turned-over original. The resultant data D1 is transferred to the register 161 in the section 160 of FIG. 23 in response to a clock signal CLK. The elements 152 corresponding to the data of low level in the shift register 161 are turned off, and the corresponding portion of the drum 10 is kept charged, so that a latent image is formed by exposure and the original image is formed. The CPU checks in step S47 whether or not the moved position of the carriage $41_1$ is the erasure stop position in accordance with the converted y-direction position data. When the CPU determines in step S47 that the moved position is the erasure start position, all "1" data is set in the register 161 in step S48, thereby performing image erasure. Thereafter, the CPU checks in step S49 whether or not the carriage $41_1$ is moved to a predetermined scanning range. If NO in step S49, the CPU checks in step S50 whether or not the copied sheet number is the same as the preset copying number. If NO in step S50, the flow advances to step S51, and the carriage $41_1$ is moved to the scanning start position. Thereafter, the flow advances to step S43 and the above operation is repeated. However, if YES in step S50, the flow advances to step S52, and the array 150 is turned off. In other words, the signal D0 is disabled and the transistor 162 in the section 160 is turned off. The flow then advances to step S4. As shown in FIG. 17, an image without the hatched portion of the original G is formed.

According to the embodiment described above, since an unnecessary portion of an original can be specified and erased, copying images can be conveniently edited.

When the erasure area is specified, an original is set on the table 2 such that an image surface of the original faces upward. In this state, the operator can specify an erasure area while visually checking the erasure area by spot light transmitted through the original, thereby simplifying the erasure area specifying operation and easily recognizing the erasure area.

Furthermore, since the source 131 is arranged in the carriage $41_1$, space can be effectively utilized to obtain a compact copying machine.

Figure 25:
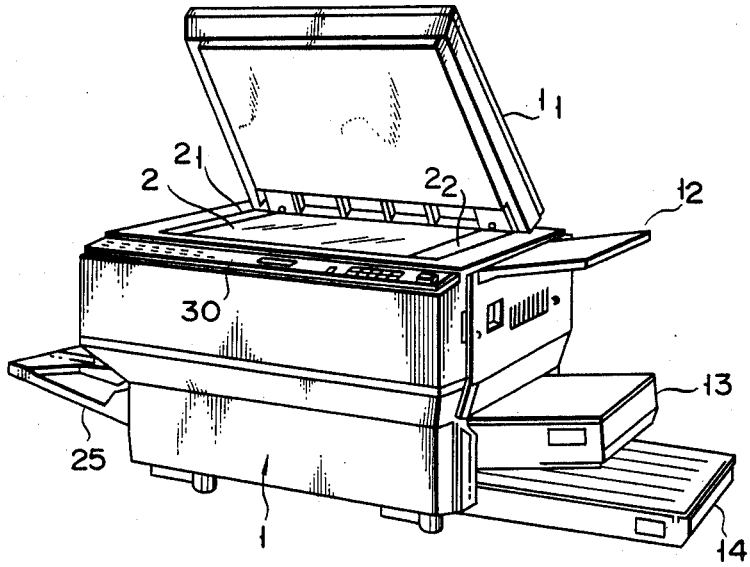
Figure 26:
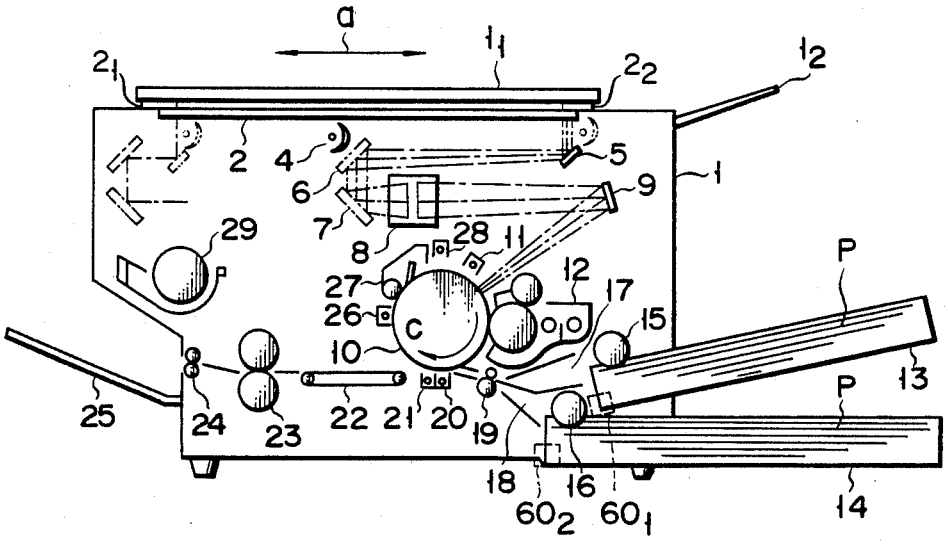

An image forming apparatus according to a second embodiment of the present invention will be described. A copying machine of the second embodiment in FIGS. 25 and 26 is substantially the same as that of the first embodiment of FIGS. 1 and 2, except that first and second fixed scales $2_1$ and $2_2$ as the original setting references are arranged at two ends of an original table 2 along the longitudinal direction thereof. The respective components of the second embodiment are the same as those of the first embodiment in FIGS. 3 to 14. However, control procedures by a controller are different from those of the first embodiment, as will be described later on.

A method of specifying an erasure area of an original in the second embodiment is different from that in the first embodiment, and performed as follows.

Figure 27:
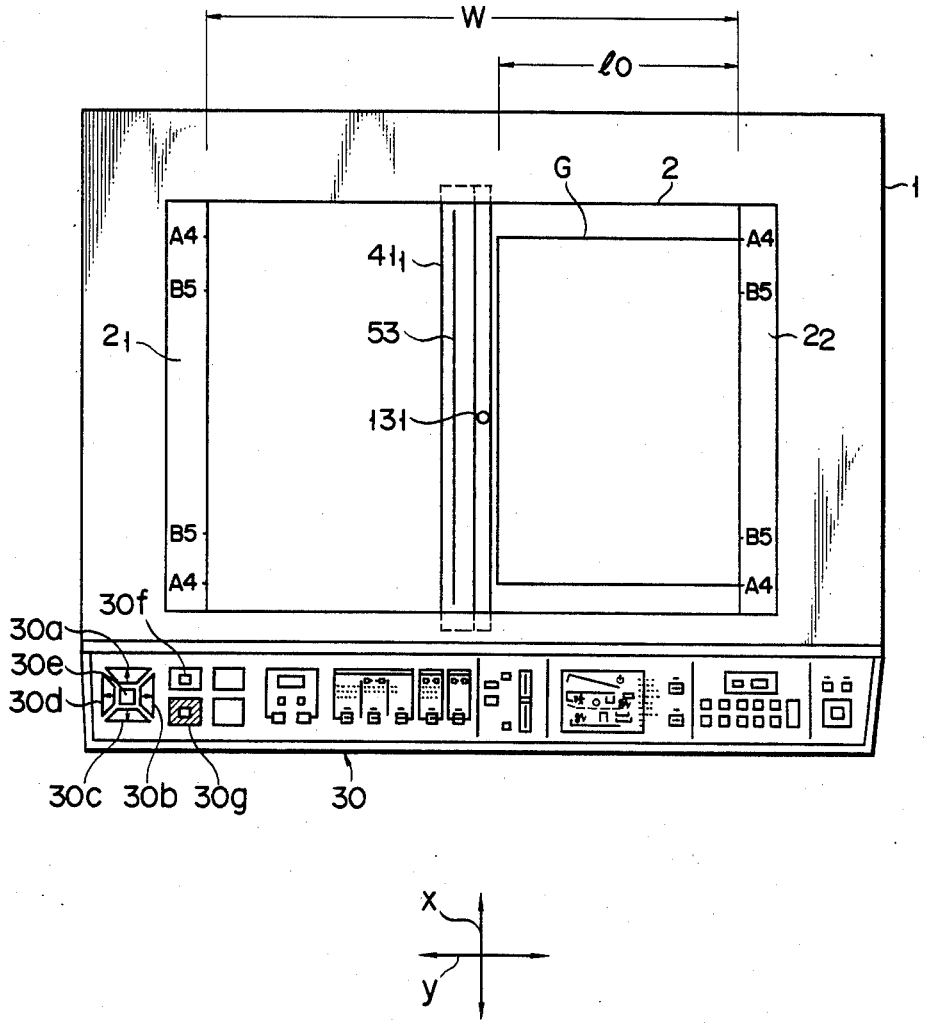

When an erasure area is specified, an original G is set on the original table along the scale $2_2$ such that a copying image surface of the original G faces upward, as shown in FIG. 27. In this case, the carriage $41_1$ is stopped at a position representing a possible copying range corresponding to a predetermined enlargement or reduction ratio. A width W between the scales $2_1$ and $2_2$ is slightly larger than the maximum document size. For example, when the maximum document size is given as A3, the long side of the document is 420 mm, so that the width W between the scales $2_1$ and $2_2$ is given as:

$$W=420+\alpha$$

When an A4 original is used, its long side is half that of the A3 original. If the long side of the A4 original is given as $l0=210$ mm, the width W is:

$W=2l0+\alpha$

Figure 28:
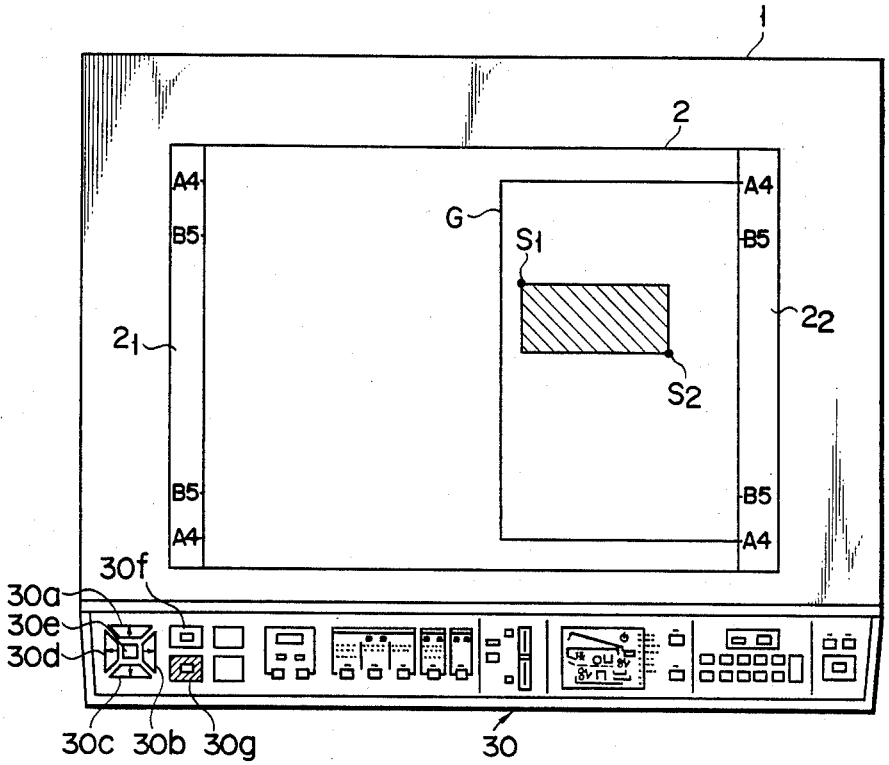
Figure 29:
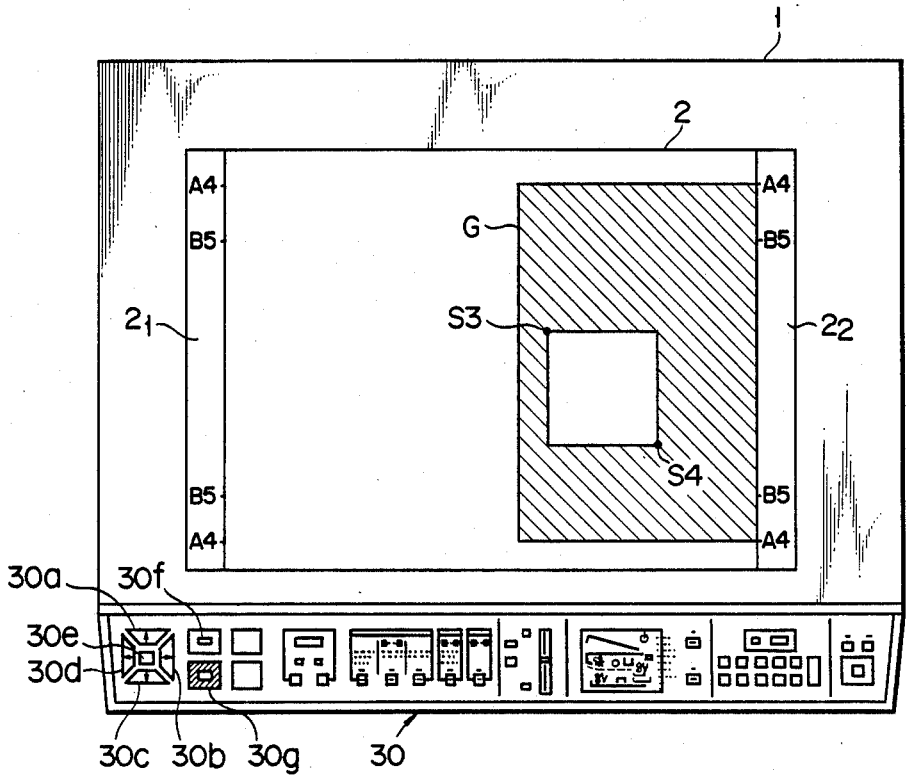
Figure 30:
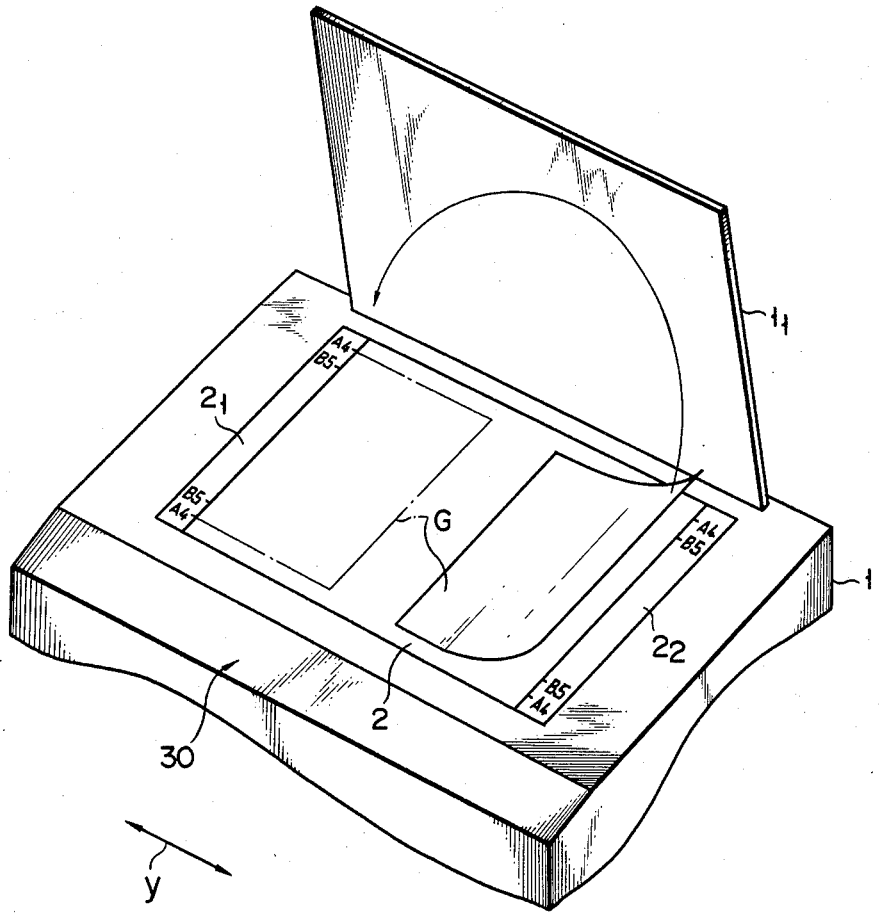

In this state, when keys 30*a* to 30*d* are selectively operated, a spot light source 131 is moved along a specified direction. More specifically, when the key 30*b* or 30*d* is depressed, a motor 33 is driven and a first carriage $41_1$ and the source 131 are moved along the scanning direction (i.e., the y direction in FIG. 27). When the key 30*a* or 30*c* is depressed, a motor 135 is driven and the source 131 is moved in a direction (i.e., the x direction in FIG. 27) perpendicular to the scanning direction. The operator selectively depresses the keys 30*a* to 30*d* while visually checking spot light transmitted through the original G. The operator shifts the spot light to a point S1 on the original G, as shown in FIG. 28, and depresses a position specifying key 30*e*. Position data specified at the point S1 is stored in the main processor group 71 of FIG. 7. Similarly, the operator shifts the spot light to a point S2 on the original G and depresses an erasure area specifying key 30*e*. Position data at the point S2 is stored in the group 71. The position data can be detected by counting the drive pulses for the motors 33 and 135. Thereafter, when the operator depresses the key 30*f*, a hatched rectangular area having the points S1 and S2 as diagonal corner points can be specified as an erasure area, as shown in FIG. 28. Similarly, when the operator specifies points S3 and S4 of the original G shown in FIG. 29 and depresses an erasure area specifying key 30*g*, a portion excluding the square having the points S3 and S4 as diagonal corner points is specified as the erasure area. In this manner, the original G having the specified erasure area is turned over in the y direction in the copying mode, as shown in FIG. 30 and is set along the scale $2_1$.

Figure 31A:
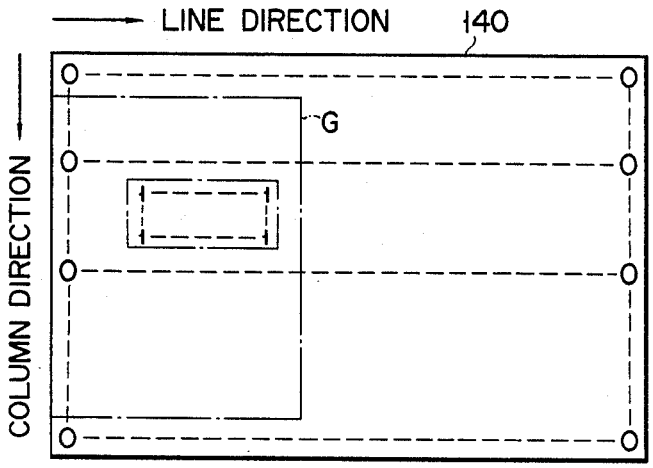
FIGS. 31A and 31B are respectively views for explaining the contents of a memory.
Figure 31B:
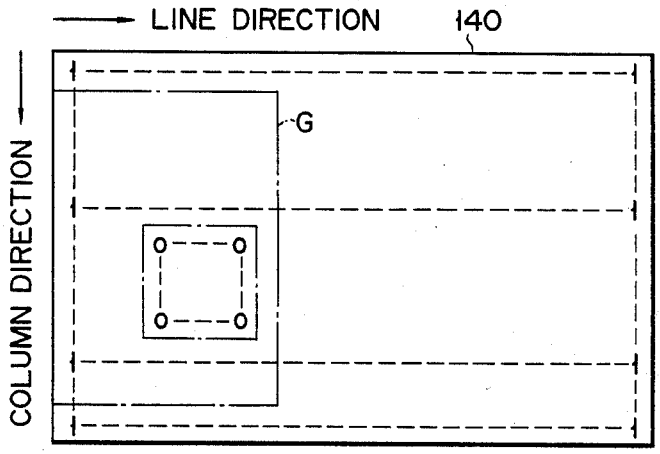

When the key 30*f* or 30*g* is depressed, the group 71 performs arithmetic operation in accordance with the specified two positions. Position data of the erasure area are set at logic "1" and position data of an area excluding the erasure area are set at logic "0". These position data are stored in the memory 140. A rank capacity of the memory 140 substantially corresponds to a value given by (moving distance of the source 131 along the x direction)÷(position resolution along the x direction). A line capacity of the memory 140 substantially corresponds to a value given by (moving distance of the source 131 along the y direction)÷(position resolution thereof along the y direction). The memory 140 comprises a RAM having the memory capacity described above. In the cases of FIGS. 28 and 29, high level signals are stored at addresses corresponding to the hatched area and low level signals are stored at other addresses in response to the data supplied from the group 71, as shown in FIGS. 31A and 31B, respectively. In this case, the original is turned over in the copying mode and is set along the scale $2_1$. Therefore, the specified erasure range is turned over such that the central portion of the original 2 along the y direction serves as the turnover center. The y-direction addresses of the high and low level signals are converted accordingly. The predetermined signals are stored at the converted addresses.

An erasure array 150 is arranged in the second embodiment in the same manner as shown in FIGS. 19A and FIGS. 20 to 22 of the first embodiment.

Figure 32:
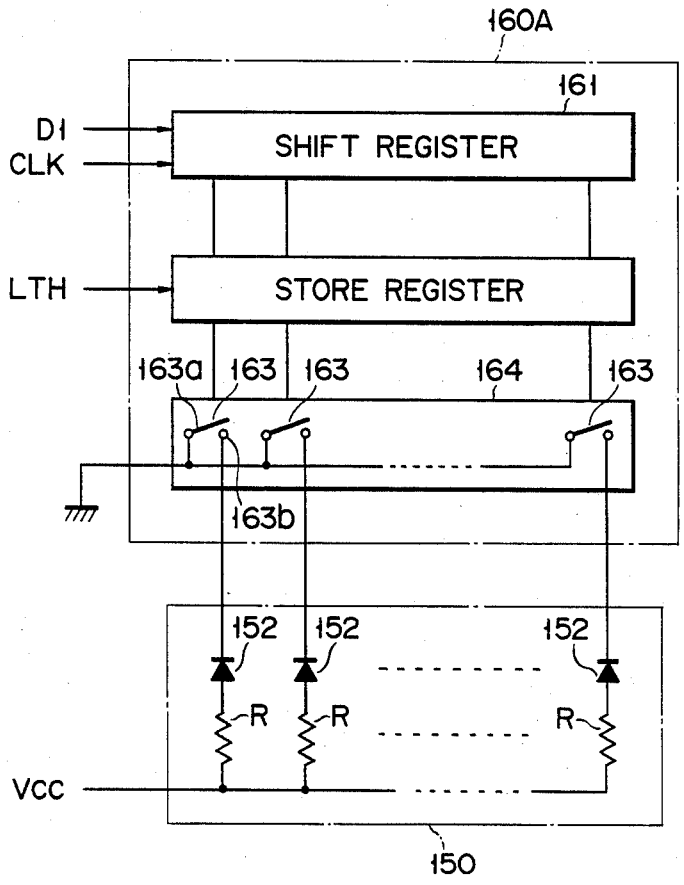

The array 150 is driven by an array drive section 160A. As shown in FIG. 32, the section 160A comprises a shift register 161 having the same bit number as the rank bit number of the memory 140, a store register 162 for storing the content of the register 161, and a switching circuit 164 consisting of a plurality of switch elements 163 which are turned on/off in response to output signals from the register 162. Movable contacts 163*a* of the elements 163 are grounded, and stationary contacts 163*b* thereof are respectively connected to the cathodes of the elements (diodes) 152 constituting the array 150. The anodes of the elements 152 are connected to a power source VCC through the corresponding current limiting resistors R.

Figure 33:
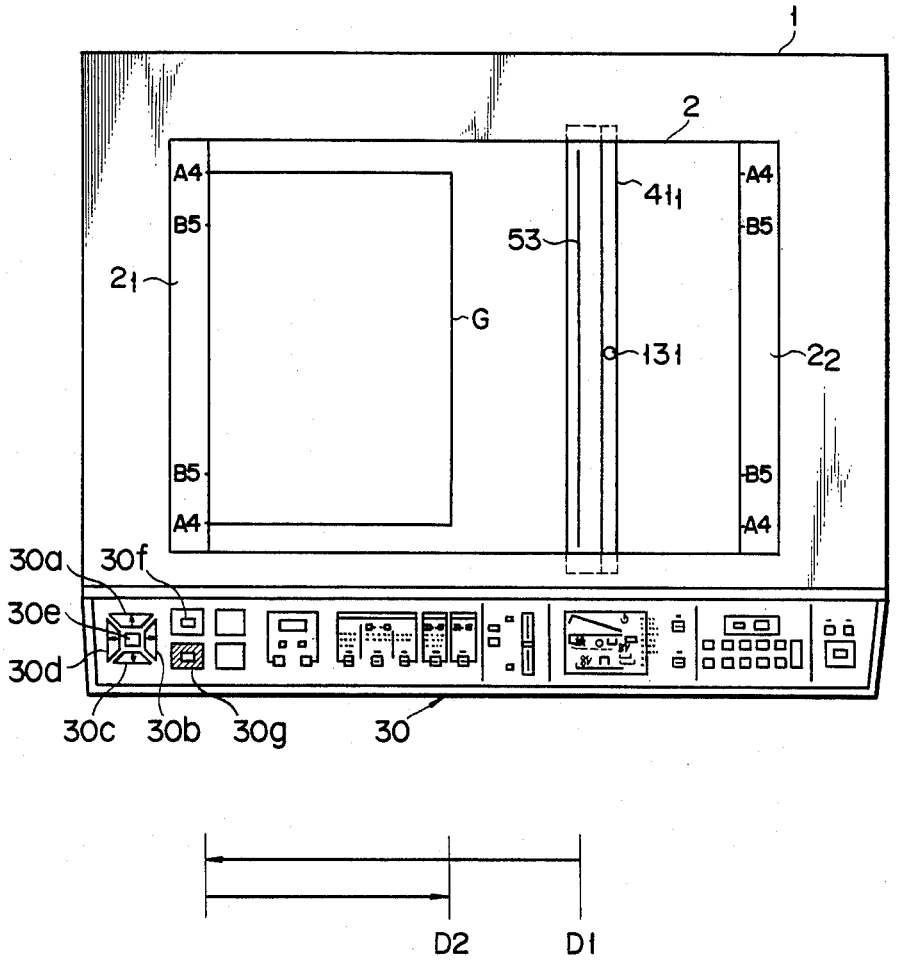

After the erasure area of the original is specified and the original is turned over and set along the scale $2_1$, he closes the original cover $1_1$ and depresses the key $30_1$. The carriage $4_1$ is moved from an erasure area specifying end position D1 toward the scale $2_1$, as shown in FIG. 33. Thereafter, the carriage $41_1$ is moved away from the scale $2_1$, and a photosensitive drum 10 is driven accordingly. One-rank data are sequentially read out along the line direction (A and B in FIG. 31) of the memory 140. The readout data D1 are transferred to the register 161 in the section 160 in response to the clock signal CLK, as shown in FIG. 32. After one-rank data is transferred to the register 161 and the charged portion of the drum 10 reaches the array 150, the group 71 generates a latch signal LTH. The storage data is supplied from the register 161 to the register 162 in response to the latch signal LTH. Since the array 150 is arranged between the charger 11 and the exposure portion Ph, the output timing of the latch signal LTH is controlled such that the one-rank data is transferred from the memory 140 to the register 162 prior to $\theta 1/\omega$ where $\theta 1$ is the angle between the array 150 and the portion Ph and $\omega$ is the peripheral velocity of the drum 10. The elements 163 in the circuit 164 are controlled in response to the output signal from the register 162. When the output of the register 162 is set at high level, the elements 163 are turned on. When the output of the register 162 is set at low level, the elements 163 are turned off. The elements 152 connected to the elements 163 are turned on when the elements 163 are turned on. Otherwise, the elements 152 are turned off. A charged drum portion corresponding to the ON elements 152 is discharged, and the remaining portion is not discharged, so that a latent image is not formed in the discharged portion even if the surface of the drum 10 is exposed with light. In this manner, the unnecessary portion for one rank is erased. The data is thus read out from the memory 140 in units of ranks, thereby erasing the unnecessary image portion. When copying is completed, the carriage $41_1$ is stopped at the position D2 representing the image formation area.

The unnecessary portion of the original can also be specified and erased in the second embodiment, so that copying image editing can be conveniently performed.

The erasure area is specified such that the copying image surface of the original faces upward at the side of the scale $2_2$, and the original is turned over toward the scale $2_1$ and is set thereat. The original is naturally handled, so that original setting errors can be prevented with high efficiency when the original is turned over to perform copying. In addition, the copying machine of the second embodiment has the same advantage as in the first embodiment.

A third embodiment of the present invention will be described hereinafter. The outer appearance and internal configuration of a copying machine of the third embodiment are substantially the same as those of the second embodiment of FIGS. 25 and 26, except an arrangement of a control panel 30A shown in FIG. 34. A black box is disposed to the right of the keys 30*f* and 30*g* of the panel 30 (FIG. 3) in the first or second embodiment. However, in the panel 30A of the third embodiment, the black box is replaced with turnover direction selection keys 30*h* and 30*i* for selecting a desired turnover direction of the original. Furthermore, turnover direction display elements 30*j* and 30*k* are respectively located to the right of the keys 30*h* and 30*i* to indicate the selected turnover direction. Therefore, FIGS. 4 to 14 and FIGS. 19A and 20 to 22 of the first and second embodiments can be applied to the respective parts of the third embodiment, and the panel 30 in FIG. 7 is replaced with the panel 30A. Furthermore, the control procedures of the controller are different (to be described later) from those of the previous embodiments.

A method of specifying an erasure area of the original in the third embodiment is different from those in the first and second embodiments and can be practiced in the following manner.

The method of specifying the erasure area of the original will be descrbied.

An original is placed on an original table 2 such that a copying image surface of the original faces upward, and an image erasure area is specified. The key 30*h* in the panel 30A is used to turn over the original along the direction perpendicular to the scanning direction and the image is copied. The key 30*i* is used to turn over the original on the table 2 in the direction parallel to the scanning direction.

Figure 35:
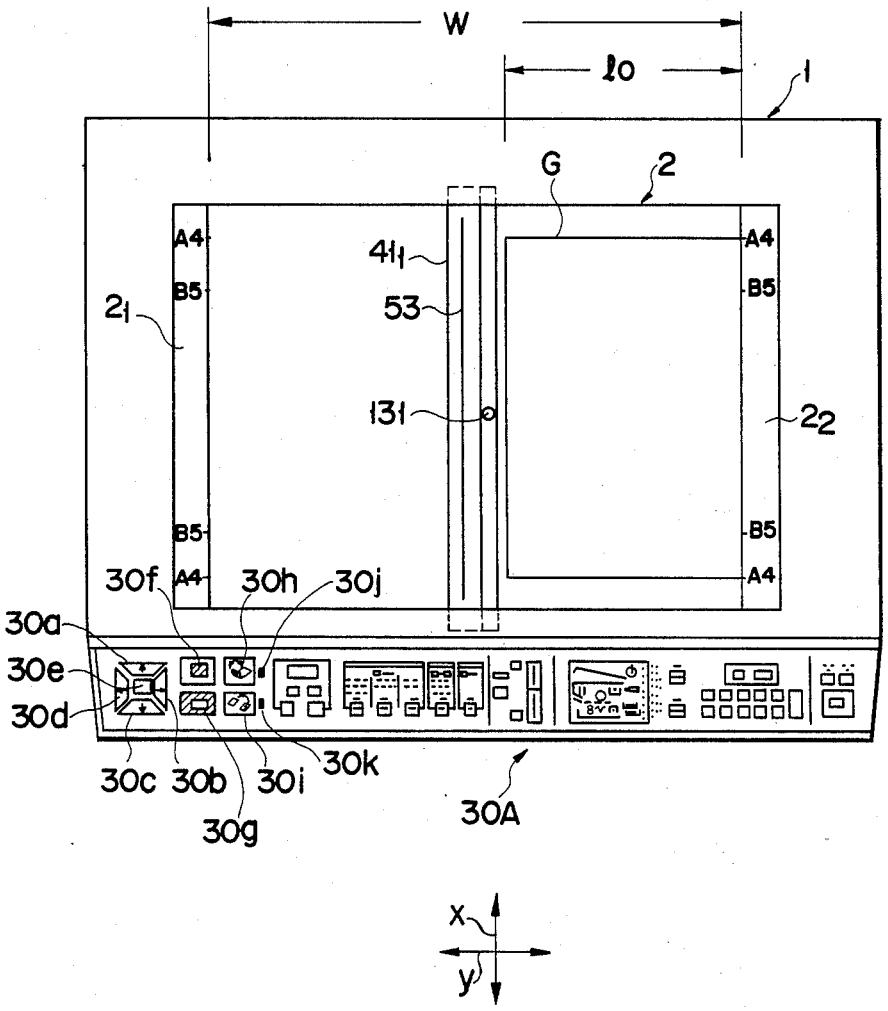

When an original G is turned over by the key 30*i* along a direction parallel to the scanning direction, the original G is set on the original table along the scale $2_2$ such that a copying image surface of the original G faces upward, as shown in FIG. 35. In this case, the carriage $41_1$ is stopped at a position representing a possible copying range corresponding to a predetermined enlargement or reduction ratio. A width W between the scales $2_1$ and $2_2$ is slightly larger than the maximum original size. For example, the maximum original size is given as A3, the long side of the original is 420 mm, so that the width W between the scales $2_1$ and $2_2$ is given as:

$$W=420+\alpha$$

When an A4 original is used, its long side is half that of the A3 original. If the long side of the A4 original is given as $l0=210$ mm, the width W is:

$$W=2l0+\alpha$$

Figure 36:
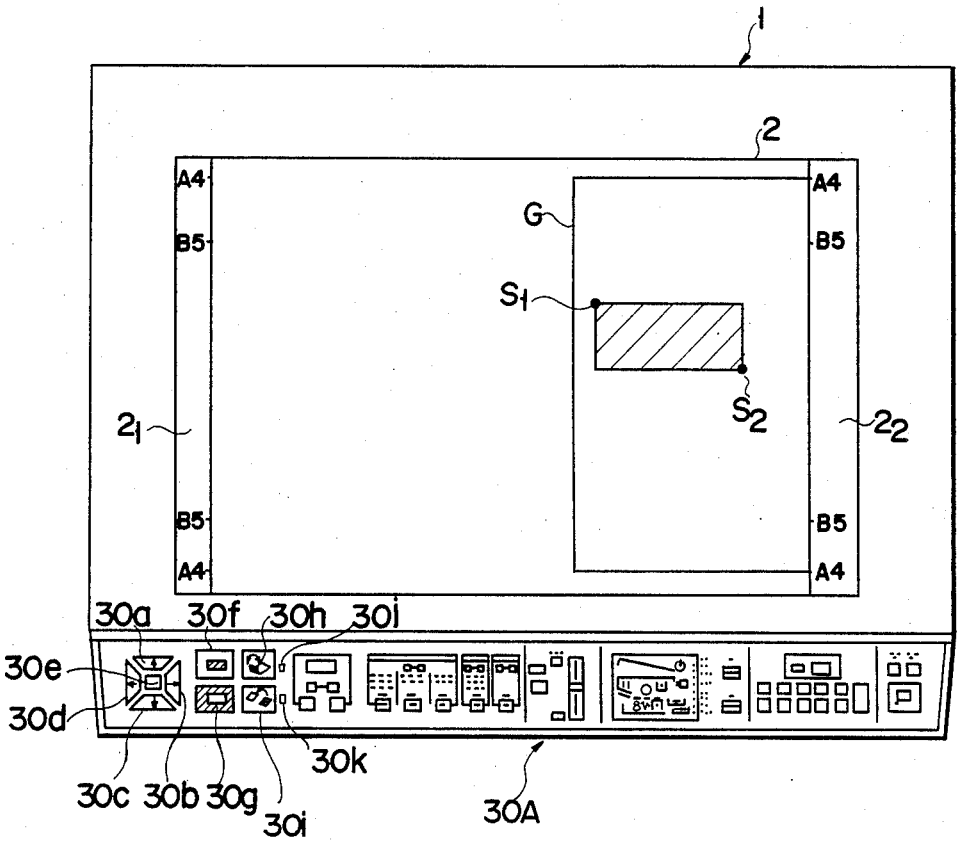
Figure 37:
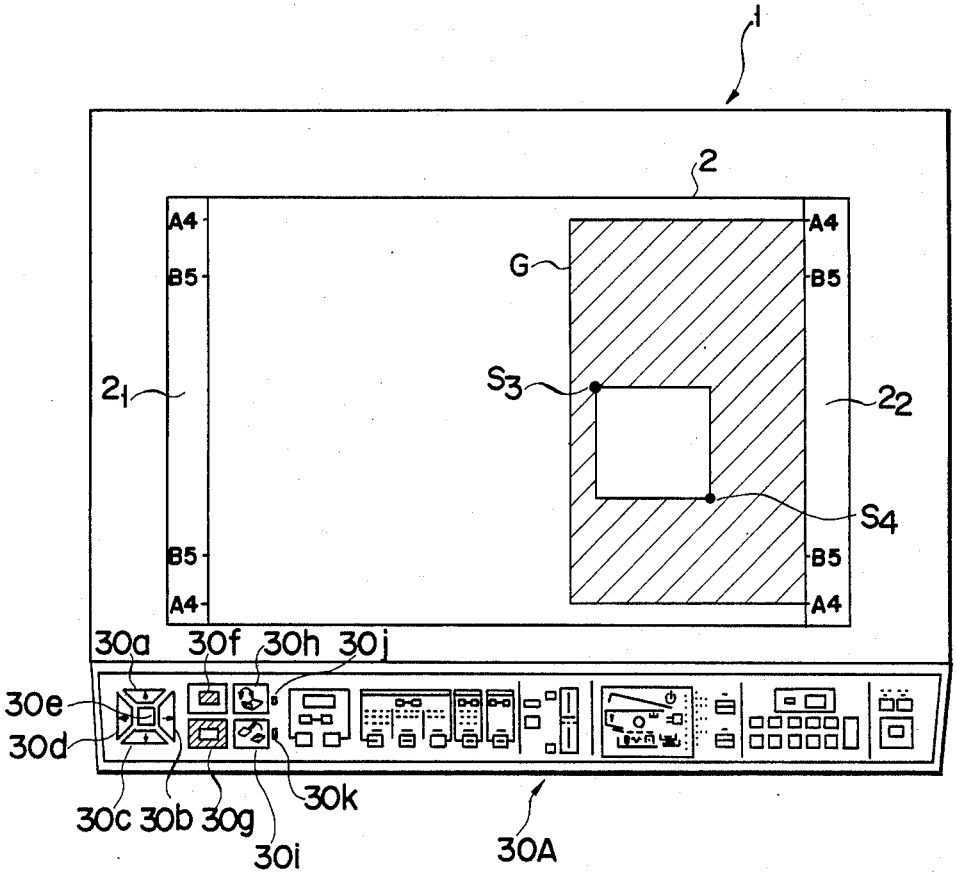
Figure 38:
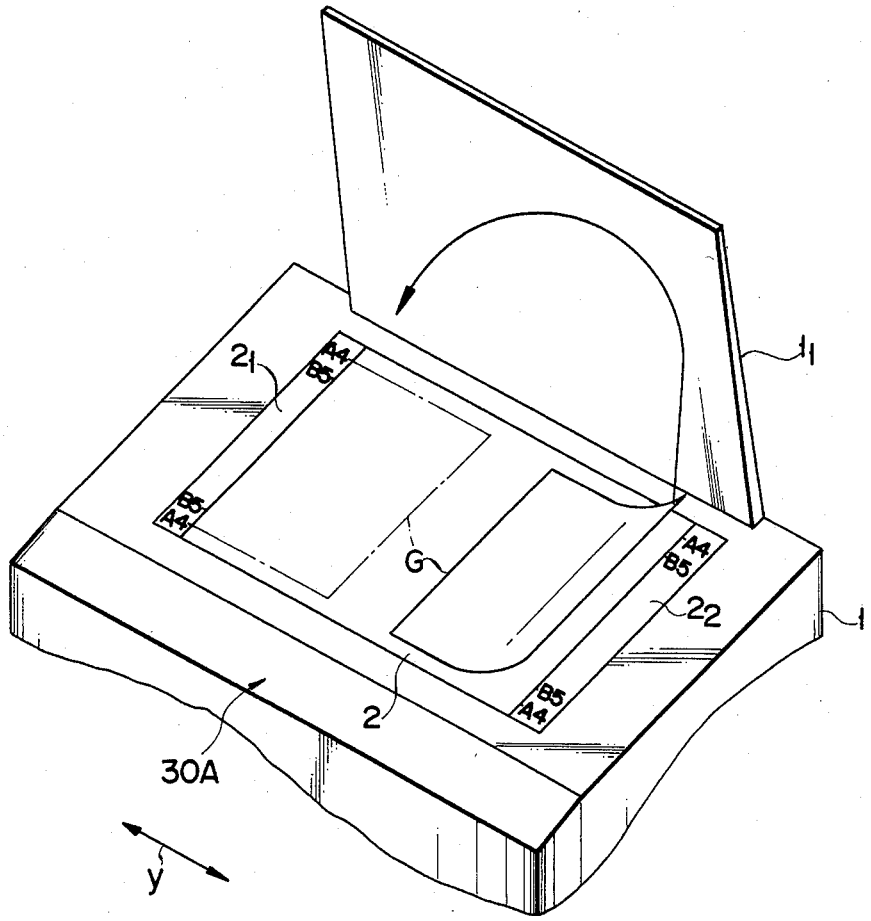

In this state, when keys 30*a* to 30*d* are selectively operated, a spot light source 131 is moved along a specified direction. More specifically, when the key 30*b* or 30*d* is depressed, a motor 33 is driven and a first carriage $41_1$ and the source 131 are moved along the scanning direction (i.e., the y direction in FIG. 35). When the key 30*a* or 30*c* is depressed, a motor 135 is driven and the source 131 is moved in a direction (i.e., the x direction in FIG. 35) perpendicular to the scanning direction. The operator selectively depresses the keys 30*a* to 30*d* while visually checking spot light transmitted through the original G. The operator shifts the spot light to a point S1 on the original G, as shown in FIG. 36, and depresses a position specifying key 30*e*. Position data specified at the point S1 is stored in the main processor group 71 of FIG. 7. Similarly, the operator shifts the spot light to a point S2 on the original G and depresses an erasure area specifying key 30*e*. Position data at the point S2 is stored in the group 71. The position data can be detected by counting the drive pulses for the motors 33 and 135. Thereafter, when the operator depresses the key 30*f*, a hatched rectangular area having diagonal vertexes as the points S1 and S2 can be specified as an erasure area, as shown in FIG. 36. Similarly, when the operator specifies points S3 and S4 of the original G shown in FIG. 37 and depresses an erasure area specifying key 30*g*, a portion excluding the square having diagonal vertexes as the points S3 and S4 is specified as the erasure area. In this manner, the original G having the specified erasure area is turned over in the y direction in the copying mode, as shown in FIG. 38 and is set along the scale $2_1$.

Figure 39A:
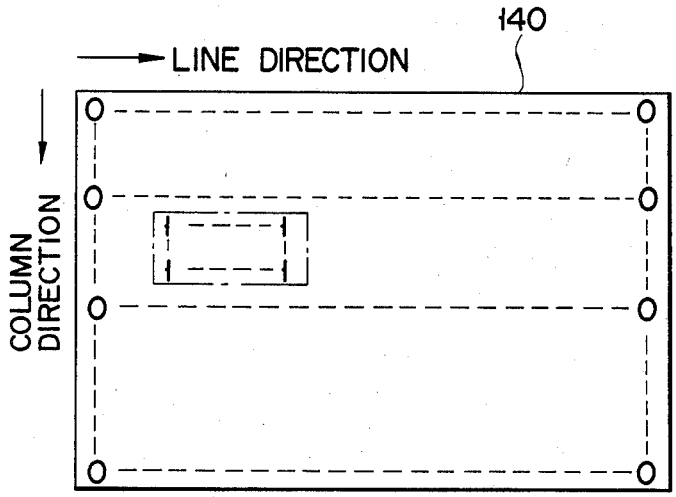
FIGS. 39A and 39B are respectively views for explaining the contents of a memory.
Figure 39B:
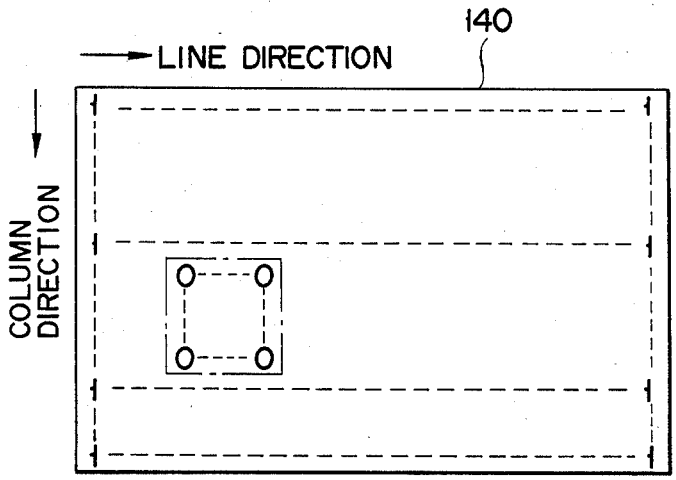

When the key 30*f* or 30*g* is depressed, the group 71 performs arithmetic operation in accordance with the specified two positions. Position data of the erasure area are set at logic "1" and position data of an area excluding the erasure area are set at logic "0". These position data are stored in the memory 140. A rank capacity of the memory 140 substantially corresponds to a value given by (moving distance of the source 131 along the x direction)÷(position resolution along the x direction). A line capacity of the memory 140 substantially corresponds to a value given by (moving distance of the source 131 along the y direction)÷(position resolution along the y direction). The memory 140 comprises a RAM having the memory capacity described above. In the cases of FIG. 36 and 37, high level signals are stored at addresses corresponding to the hatched area and low level signals are stored at other addresses in response to the data supplied from the group 71, as shown in FIGS. 39A and 39B, respectively. In this case, the original is turned over in the copying mode and is set along the scale $2_1$, and the specified erasure range is turned over such that the central portion of the original 2 along the y direction serves as the turnover center. The y-direction addresses of the high and low level signals are converted accordingly. The predetermined signals are stored at the converted addresses.

Figure 40:
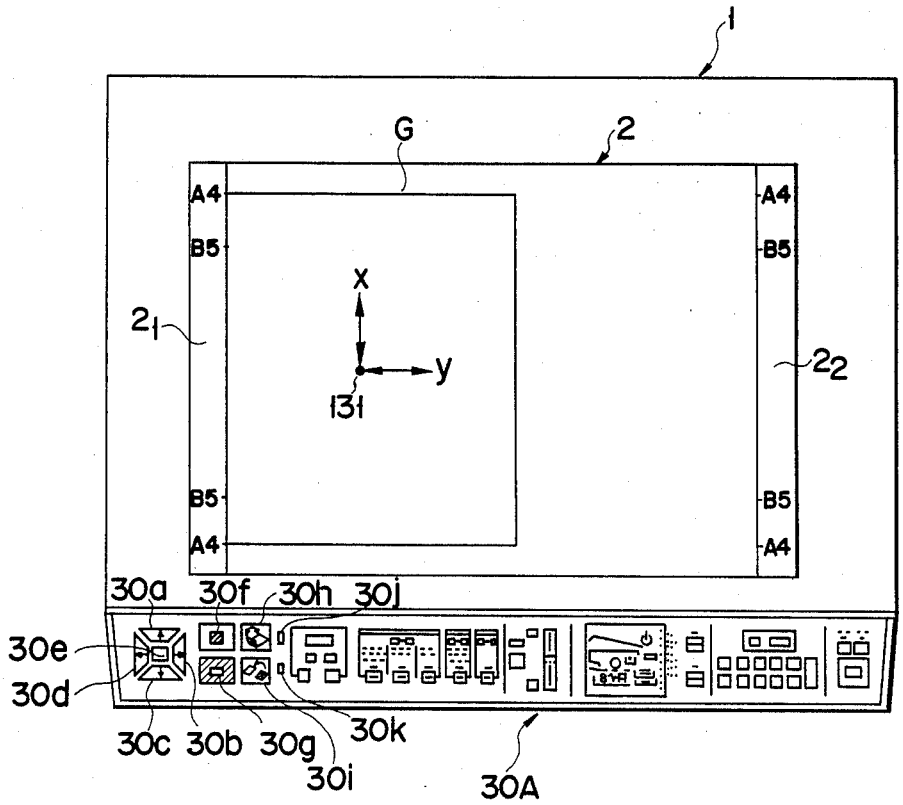

When the original G is turned over by the key 30*h* along a direction perpendicular to the scanning direction, an original G is set on the original table along the scale $2_1$ such that a copying image surface of the original G faces upward, as shown in FIG. 40.

Figure 41:
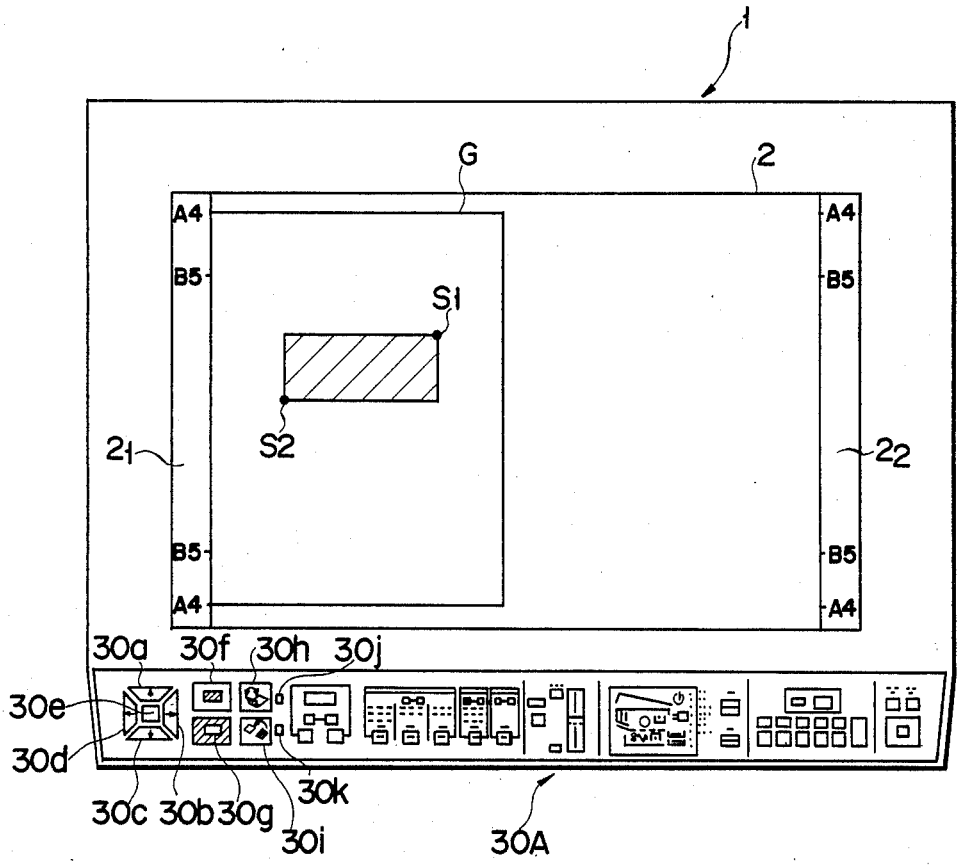
Figure 42:
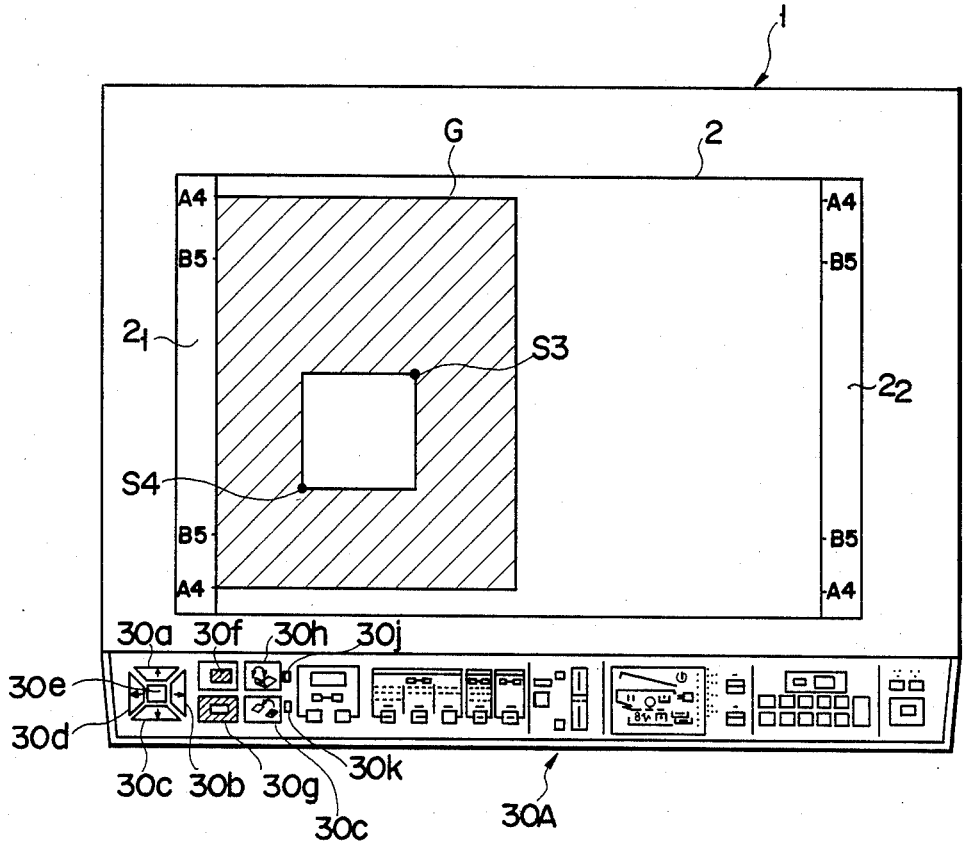
Figure 43:
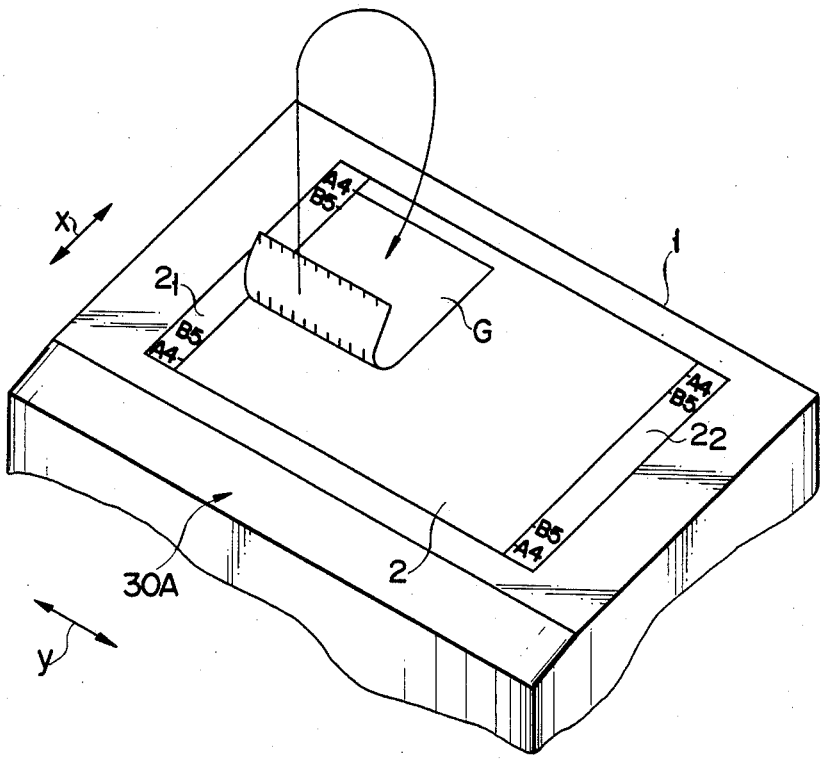

In this state, when the keys 30*a* to 30*d* are selectively operated, the spot light source 131 is moved along a specified direction. More specifically, when the key 30*b* or 30*d* is depressed, the motor 33 is driven and the first carriage $41_1$ and the source 131 are moved along the scanning direction (i.e., the y direction in FIG. 40). When the key 30*a* or 30*c* is depressed, the motor 135 is driven and the source 131 is moved in a direction (i.e., the x direction in FIG. 40) perpendicular to the scanning direction. The operator selectively depresses the keys 30*a* to 30*d* while visually checking spot light transmitted through the original G. The operator shifts the spot light to a point S1 on the original G, as shown in FIG. 41, and depresses the position specifying key 30*e*. Position data specified at the point S1 is stored in the main processor group 71 of FIG. 7. Similarly, the operator shifts the spot light to a point S2 on the original G and depresses the erasure area specifying key 30*e*. Position data at the point S2 is stored in the group 71. The position data can be detected by counting the drive pulses for the motors 33 and 135. Thereafter, when the operator depresses the key 30*f*, a hatched rectangular area having diagonal vertexes as the points S1 and S2 can be specified as an erasure area, as shown in FIG. 41. Similarly, when the operator specifies points S3 and S4 of the original G shown in FIG. 42 and depresses the erasure area specifying key 30*g*, a portion excluding the square having diagonal vertexes as the points S3 and S4 is specified as the erasure area. In this manner, the original G having the specified erasure area is turned over in the x direction in the copying mode, as shown in FIG. 43 and is set along the scale $2_1$. Since the original is turned over along the x direction in the copying mode and is set along the scale $2_1$, the specified erasure range is turned over such that the central portion of the original 2 along the x direction serves as the turnover center. The x-direction addresses of the high and low level signals are converted accordingly. The predetermined signals are stored at the converted addresses. Selective erasure of the original image can be subsequently performed in the same procedures as in FIG. 2.

According to the third embodiment, when the original G is copied after its erasure area is specified, the turnover direction of the original G can be selected from x and y directions, thereby improving operation efficiency. In addition, the third embodiment has the same advantages as in the first and second embodiments.

Figure 19B:
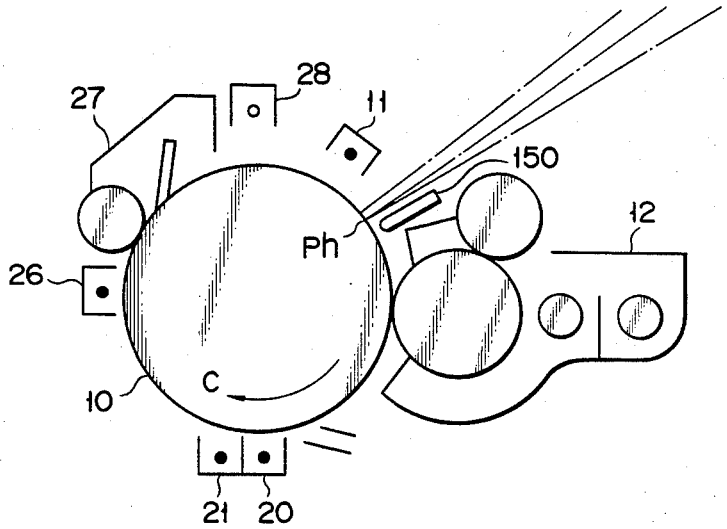
FIG. 19B is a side sectional view of the principal part showing another arrangement of the erasure array.

The present invention is not limited to the particular embodiments descibed above. For example, the position of the array 150 is not limited in a location between the charger 11 and the portion Ph, as shown in FIG. 19A, but can be located between the portion Ph and the unit 12, as shown in FIG. 19B, so as to erase the latent image in accordance with the specified data.

The capacity of the memory may be changed as needed.

Other changes and modifications may be made within the spirit and scope of the invention.

According to the present invention as described in detail, there is provided a simple image forming apparatus for allowing the operator to edit or omit an unnecessary portion of an original with high efficiency.

What is claimed is:

1. An image forming apparatus which can form a selected portion of an image, the apparatus comprising:

an original table on which a light-transparent original is placed with an original image surface turned upward or downward;

light-transmitting means for emitting light through the original placed on the original table, with the original image surface turned upward, while the light is moved relative to the original;

erasure area specifying means for specifying an unnecessary portion of the original image, while the light is being moved;

erasure area storage means for storing the data representing the position of the erasure area specified by the erasure area specifying means;

original scanning means having an optical system movable along the original table, and adapted to scan the original placed on the original table, with the original image surface turned downward;

image forming means for focusing the light emitted from the original scanning means and then reflected by the original for developing an image on an image forming medium;

image erasing means for causing the image forming means to form the image, except for a selected portion thereof; and control means for reading the data representing the position of the erasure area from the erasure area storage means at any time during the operation of the image forming means, and for supplying this data to the image erasing means.

2. An apparatus according to claim 1, wherein said light-transmitting means includes a light-emitting element and a lens which are arranged to be movable with respect to said original scanning means along a direction perpendicular to a moving direction of said original scanning means, said light-emitting element and said lens being arranged to form spot light as the transmission light.

3. An apparatus according to claim 1, wherein said erasure area specifying means includes means for calculating the position data corresponding to a position of the original which represents a specified erasure area.

4. An apparatus according to claim 1, wherein said image erasing means includes a plurality of light-emitting elements linearly arranged so as to oppose said image forming means.

5. An apparatus according to claim 4, wherein said plurality of light-emitting elements are located at positions subjected to selective light emission to said image forming means during focusing by said image forming means.

6. An apparatus according to claim 4, wherein said plurality of light-emitting elements are located at positions subjected to selective light emission to said image forming means during development by said image forming means.

7. An image forming apparatus with image forming area selection, said apparatus comprising:

an original table on which a light-transparent original is set at one end or the other end such that an original image surface selectively faces upward or downward;

light-transmitting means for emitting light transmitting through the original set at said one end such that the original image surface faces upward on said original table while the light is shifted with respect to the original;

erasure area specifying means for specifying an unnecessary portion of the original image surface to specify an erasure area while the light from said light-transmitting means is being shifted;

erasure area storage means for storing position data of the erasure area specified by said erasure area specifying means;

original scanning means, having an optical system moved along said original table, for scanning the original placed at said other end such that the original image surface faces downward;

image forming means for focusing light emitted from said original scanning means and reflected by the original and for developing an image on an image forming medium to form an image;

image erasing means for selectively erasing an image to be formed by said image forming means; and control means for reading out the position data corresponding to the erasure area from said erasure area storage means at any time during the operation of said image forming means and supplying the position data to said image erasing means.

8. An apparatus according to claim 7, wherein said light-transmitting means includes a light-emitting element and a lens which are arranged to be movable with respect to said original scanning means along a direction perpendicular to a moving direction of said original scanning means, said light-emitting element and said lens being arranged to form spot light as the transmission light.

9. An apparatus according to claim 7, wherein said erasure area specifying means includes means for calculating the position data corresponding to a position of the original which represents a specified erasure area.

10. An apparatus according to claim 7, wherein said image erasing means includes a plurality of light-emitting elements linearly arranged so as to oppose said image forming means.

11. An apparatus according to claim 10, wherein said plurality of light-emitting elements are located at positions subjected to selective light emission to said image forming means during focusing by said image forming means.

12. An apparatus according to claim 10, wherein said plurality of light-emitting elements are located at positions subjected to selective light emission to said image forming means during development by said image forming means.

13. An apparatus according to claim 7, wherein first and second scales as setting references of the original are arranged at said one end and said other end of said original table, respectively.

14. An image forming apparatus with image forming area selection, said apparatus comprising:

an original table on which a light-transparent original is set at one end or the other end such that an original image surface selectively faces upward or downward;

light-transmitting means for emitting light transmitting through the original set at said one end such that the original image surface faces upward on said original table while the light is shifted with respect to the original;

erasure area specifying means for specifying an unnecessary portion of the original image surface to specify an erasure area while the light from said light-transmitting means is being shifted;

erasure area storage means for storing position data of the erasure area specified by said erasure area specifying means;

original scanning means, having an optical system moved along said original table, for scanning the original placed at said other end such that the original image surface faces downward by selectively changing a turnover direction;

image forming means for focusing light emitted from said original scanning means and reflected by the original and for developing an image on an image forming medium to form an image;

image erasing means for selectively erasing an image to be formed by said image forming means;

turnover direction specifying means for specifying a predetermined turnover direction of the original set on said original table when scanning is performed by said original scanning means; and control means for reading out the position data corresponding to the erasure area from said erasure area storage means at any time during the operation of said image forming means in accordance with the turnover direction specified by said turnover direction specifying means and supplying the position data to said image erasing means.

15. An apparatus according to claim 14, wherein said light-transmitting means includes a light-emitting element and a lens which are arranged to be movable with respect to said original scanning means along a direction perpendicular to a moving direction of said original scanning means, said light-emitting element and said lens being arranged to form spot light as the transmission light.

16. An apparatus according to claim 14, wherein said erasure area specifying means includes means for calculating the position data corresponding to a position of the original which represents a specified erasure area.

17. An apparatus according to claim 14, wherein said image erasing means includes a plurality of light-emitting elements linearly arranged so as to oppose said image forming means.

18. An apparatus according to claim 17, wherein said plurality of light-emitting elements are located at positions subjected to selective light emission to said image forming means during focusing by said image forming means.

19. An apparatus according to claim 17, wherein said plurality of light-emitting elements are located at positions subjected to selective light emission to said image forming means during development by said image forming means.

20. An apparatus according to claim 14, wherein first and second scales as setting references of the original are arranged at said one end and said other end of said original table, respectively.

* * * * *